US011127354B2

(12) United States Patent
Shin et al.

(10) Patent No.: US 11,127,354 B2
(45) Date of Patent: Sep. 21, 2021

(54) DISPLAY DEVICE

(71) Applicant: Samsung Display Co., Ltd., Yongin-si (KR)

(72) Inventors: Yong Hwan Shin, Yongin-si (KR); Jun Hee Moon, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/779,387

(22) Filed: Jan. 31, 2020

(65) Prior Publication Data

US 2020/0302876 A1 Sep. 24, 2020

(30) Foreign Application Priority Data

Mar. 19, 2019 (KR) ..... 10-2019-0031411

(51) Int. Cl.
*G09G 3/3266* (2016.01)
*G09G 3/3225* (2016.01)

(52) U.S. Cl.
CPC ..... *G09G 3/3266* (2013.01); *G09G 3/3225* (2013.01); *G09G 2300/0426* (2013.01); *G09G 2310/0202* (2013.01); *G09G 2310/0281* (2013.01); *G09G 2320/0233* (2013.01)

(58) Field of Classification Search
CPC .. G09G 3/3266; G09G 3/3225; G09G 3/3648; G09G 3/367–3696; G09G 3/3233; G09G 2310/0281; G09G 2310/0202; G09G 2310/0286; G09G 2310/0232; G09G 2310/0262; G09G 2310/0297; G09G 2310/0221; G09G 2310/0251; G09G 2310/06; G09G 2310/08; G09G 2300/0842; G09G 2300/0426; G09G 2300/043; G09G 2300/0819; G09G 2300/0814; G09G 2300/0861; G09G 2300/0408; G09G 2300/0413; G09G 2320/0233; G09G 2320/0223; G09G 2320/0626; G09G 2330/04; G02F 1/13452; G02F 1/136286; H01L 27/3276; H01L 27/3223; H01L 27/124; H01L 27/3297; H01L 27/3265; H01L 27/1255; H01L 27/326; H01L 27/3246
See application file for complete search history.

(56) References Cited

U.S. PATENT DOCUMENTS

2008/0117155 A1* 5/2008 Li ..... G09G 3/3677 345/91
2017/0110041 A1 4/2017 Watsuda
2017/0301280 A1* 10/2017 Ka ..... G09G 3/3406
(Continued)

FOREIGN PATENT DOCUMENTS

KR 10-2017-0119270 A 10/2017

*Primary Examiner* — Nitin Patel
*Assistant Examiner* — Amen W. Bogale
(74) *Attorney, Agent, or Firm* — Lewis Roca Rothgerber Christie LLP

(57) ABSTRACT

A display device includes: a substrate including a first region and a second region at one side of the first region; a plurality of pixels in the first region; a first gate line connected to a first pixel among the pixels; a second gate line connected to a second pixel among the pixels; a first capacitor in the second region; and a first selector configured to select one of the first gate line and the second gate line and connect the selected one to the first capacitor.

19 Claims, 18 Drawing Sheets

(56) References Cited

U.S. PATENT DOCUMENTS

| | | | | |
|---|---|---|---|---|
| 2017/0337876 | A1* | 11/2017 | Kim | G09G 3/3233 |
| 2018/0158417 | A1 | 6/2018 | Xiang et al. | |
| 2018/0166018 | A1 | 6/2018 | Yang | |
| 2018/0204889 | A1 | 7/2018 | Yu et al. | |
| 2019/0096914 | A1* | 3/2019 | Hosokawa | G02F 1/136286 |

* cited by examiner

PPA: PPA1, PPA2, PPA3
PXA: PXA1, PXA2, PXA3
PXL: PXL1, PXL2, PXL3
SDV: SDV1, SDV2, SDV3
EDV: EDV1, EDV2, EDV3

PXA : PXA1, PXA2, PXA3, PXA4

DISPLAY DEVICE

CROSS-REFERENCE TO RELATED APPLICATION

The present application claims priority to and the benefit of Korean patent application 10-2019-0031411 filed on Mar. 19, 2019 in the Korean Intellectual Property Office, the entire disclosure of which is incorporated herein by reference.

BACKGROUND

1. Field

Aspects of some example embodiments of the present disclosure generally relate to a display device.

2. Description of the Related Art

A display device may include pixels and lines, and each of the pixels may include a light emitting device and transistors connected to the light emitting device to drive the light emitting device.

When the display device includes regions having different areas, lines located in the regions may have different lengths. The lines may have different load values depending on their lengths, and a brightness difference caused by differences between load values may occur in a final image provided by the display device.

A load matching capacitor may be formed and connected to the lines, so that the loads of the lines can be adjusted equal or similar to each other. However, the area of a dead space of the display device may be increased so as to provide the load matching capacitor.

The above information disclosed in this Background section is only for enhancement of understanding of the background and therefore it may contain information that does not constitute prior art.

SUMMARY

Some example embodiments may provide a display device having uniform brightness while minimizing or reducing area of a dead space.

According to some example embodiments of the present disclosure, a display device includes: a substrate including a first region and a second region at one side of the first region; pixels provided in the first region; a first gate line connected to a first pixel among the pixels; a second gate line connected to a second pixel among the pixels; a first capacitor in the second region; and a first selector configured to select one of the first gate line and the second gate line and connect the selected one to the first capacitor.

According to some example embodiments, the first capacitor may include: a power supply line in the second region, the power supply line being connected to the pixels; and a connection line overlapping with the power supply line. The first selector may connect the one selected from the first gate line and the second gate line to the connection line.

According to some example embodiments, the display device may further include a first selection line and a second selection line. The first selector may include: a first switching element including a first electrode connected to the first gate line, a second electrode connected to the first capacitor, and a gate electrode connected to the first selection line; and a second switching element including a first electrode connected to the second gate line, a second electrode connected to the first capacitor, and a gate electrode connected to the second selection line.

According to some example embodiments, the first switching element may be turned on while a gate signal having a turn-on voltage level is being applied to the first gate line, and the second switching element may be turned on while a gate signal having a turn-on voltage level is being applied to the second gate line.

According to some example embodiments, a first section in which the first switching element is turned on may not overlap with a second section in which the second switching element is turned on.

According to some example embodiments, the display device may further include: a third gate line connected to a third pixel among the pixels; and a third selection line. The first selector may further include a third switching element including a first electrode connected to the third gate line, a second electrode connected to the first capacitor, and a gate electrode connected to the third selection line.

According to some example embodiments, the display device may further include: a third gate line connected to a third pixel among the pixels; a fourth gate line connected to a fourth pixel among the pixels; a second capacitor in the second region; a third selection line; and a fourth selection line. The first selector further may include: a third switching element including a first electrode connected to the third gate line, a second electrode connected to the second capacitor, and a gate electrode connected to the third selection line; and a fourth switching element including a first electrode connected to the fourth gate line, a second electrode connected to the second capacitor, and a gate electrode connected to the fourth selection line.

According to some example embodiments, the first section in which the first switching element is turned on may be larger than a section in which the gate signal applied to the first gate line has a turn-on voltage level.

According to some example embodiments, the first section in which the first switching element is turned on may not overlap with the second section in which the second switching element is turned on, and a third section in which the third switching element may be turned on partially overlaps with each of the first section and the second section.

According to some example embodiments, the display device may further include: a third gate line between the first gate line and the second gate line, the third gate line being connected to a third pixel among the pixels; a second capacitor in the second region; and a third selection line. The first selector may further include a third switching element including a first electrode connected to the third gate line, a second electrode connected to the second capacitor, and a gate electrode connected to the third selection line.

According to some example embodiments, the first section in which the first switching element is turned on may not overlap with the second section in which the second switching element is turned on, and a third section in which the third switching element is turned on may partially overlap with each of the first section and the second section.

According to some example embodiments, the display device may further include: a third gate line; a fourth gate line; and a second selector configured to alternately connect the third gate line and the fourth gate line to the first capacitor. The substrate may further include a third region spaced apart from the first region with respect to the second region. The third gate line may be connected to a third pixel provided in the third region, and be connected to the first gate line through the second selector, the first capacitor, and the first selector. The fourth gate line may be connected to a forth pixel provided in the third region, and be connected to the second gate line through the second selector, the first capacitor, and the first selector.

According to some example embodiments, the display device may further include a third gate line. The substrate may further include a third region adjacent to each of the first region and the second region. The third gate line may be connected to a third pixel provided in the third region. The first gate line may be shorter than the third gate line.

According to some example embodiments, the second region may be surrounded by the first region and the third region.

According to some example embodiments, the display device may further include a first driver at one side of the substrate, the first driver being connected to the first gate line and the second gate line, the first driver providing a gate signal having a turn-on voltage level to the first gate line and the second gate line in different sections.

According to some example embodiments, the display device may further include a second driver at the other side of the substrate, the second driver being connected to the first gate line and the second gate line, the second driver providing the gate signal to the first gate line and the second gate line.

According to some example embodiments, the second gate line may have a load equal to that of the first gate line.

According to some example embodiments, the display device may further include a load controller configured to provide a first selection signal for selecting the first gate line to the first selector in a section in which the gate signal is applied to the first gate line.

According to some example embodiments of the present disclosure, there is provided a display device including: a substrate including a first region and second and third regions spaced apart from each other with respect to the first region; first pixels provided in the second region; second pixels provided in the third region; first gate lines connected to the first pixels; second gate lines connected to the second pixels; a connection line in the first region; a first selector configured to select one of the first gate lines and connect the selected one to the connection line; and a second selector configured to select one of the second gate lines and connect the selected one to the connection line.

According to some example embodiments, the display device may further include a power supply line in the second region, the power supply line being connected to the pixels. The connection line may form a capacitor by partially overlapping with the power supply line.

According to some example embodiments of the present disclosure, the display device includes a capacitor (or load matching capacitor) shared by gate lines. Thus, the display device can have uniform brightness, and the area of a dead space can be decreased.

BRIEF DESCRIPTION OF THE DRAWINGS

Aspects of some example embodiments will now be described more fully hereinafter with reference to the accompanying drawings; however, they may be embodied in different forms and should not be construed as limited to the example embodiments set forth herein. Rather, these embodiments are provided so that this disclosure will be more thorough and more complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
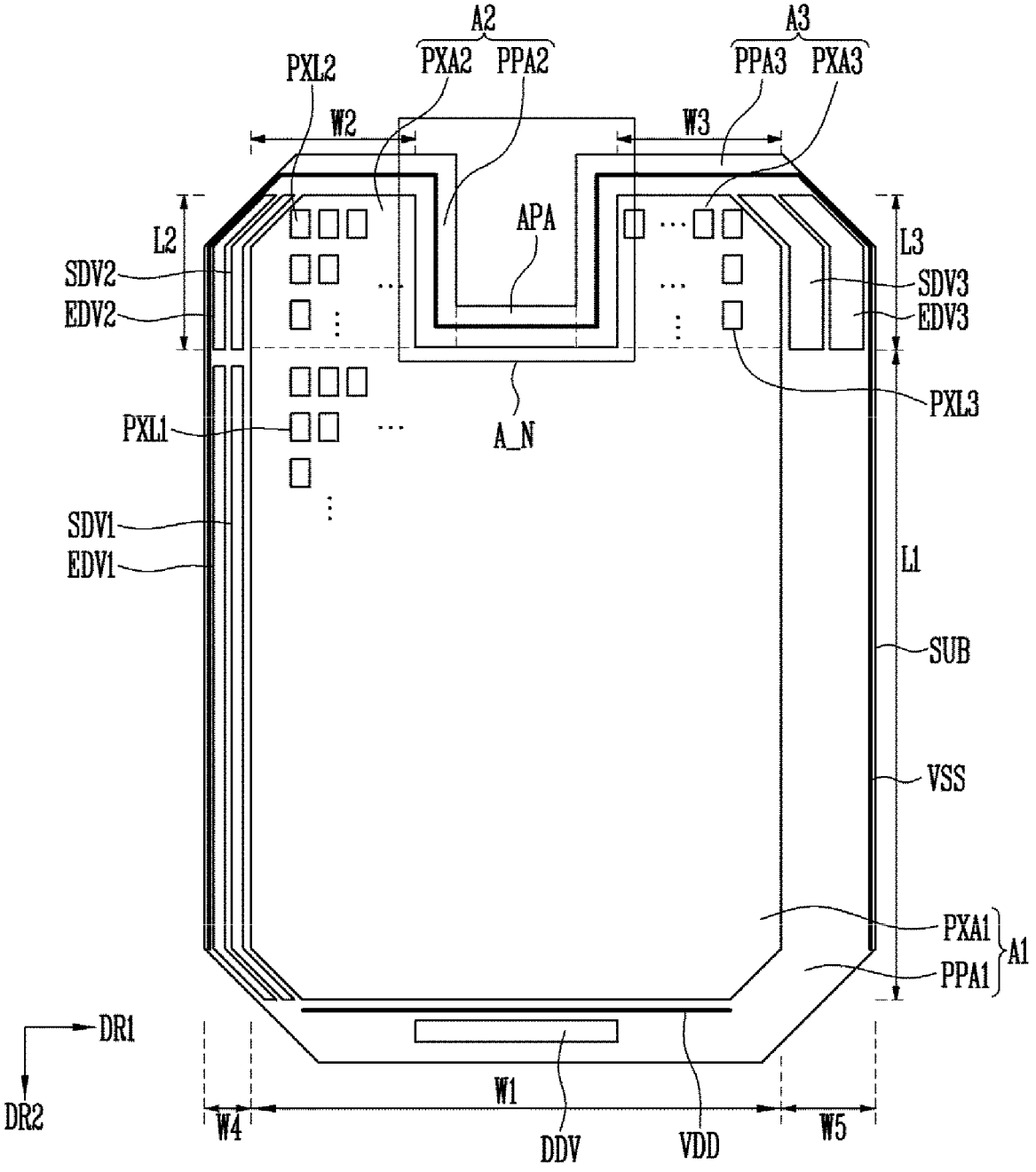
FIG. 1 is a plan view illustrating a display device according to some example embodiments of the present disclosure.

Example embodiments according to the present disclosure may apply various changes and different shape, therefore only illustrate details of certain examples. However, the examples do not limit to certain shapes but apply to all the change and equivalent material and replacement.

Meanwhile, in the following example embodiments and the attached drawings, elements not directly related to the present disclosure may be omitted from depiction, and dimensional relationships among individual elements in the attached drawings are illustrated only for ease of understanding but not to limit the actual scale. It should note that in giving reference numerals to elements of each drawing, like reference numerals refer to like elements even though like elements are shown in different drawings.

FIG. 1 is a plan view illustrating a display device in according to some example embodiments of the present disclosure.

Referring to FIG. 1, the display device may include a substrate SUB, pixels PXL1, PXL2, and PXL3 (hereinafter, referred to as PXL), a driver provided on the substrate SUB to drive the pixels PXL, and a line part connecting the pixels PXL and the driver. Also, the display device may further include a power supply configured to supply a power source to the pixel PXL.

The substrate SUB may include regions A1, A2, and A3, and at least two of the regions A1, A2, and A3 may have different areas. The regions A1, A2, and A3 may be divided by dispositions, lengths, etc., of corresponding lines.

Although a case where the substrate SUB includes first to third regions A1, A2, and A3 is illustrated in FIG. 1, this is merely illustrative, and the substrate SUB is not limited thereto. For example, the substrate SUB may have two regions or four or more regions, and at least two of the regions may have different areas.

Each of the first to third regions A1, A2, and A3 may have various shapes. For example, each of the first to third regions A1, A2, and A3 may be provided in various shapes such as a closed polygon including linear sides, a circle, an ellipse, etc., including curved sides, and a semicircle, a semi-ellipse, etc., including linear and curved sides.

According to some example embodiments, each of the first to third regions A1, A2, and A3 may have an approximately quadrangular shape, and have a shape in which a region adjacent to at least one vertex among vertices of the quadrangular shape is removed. The removed region adjacent to at least one vertex among the vertices of the quadrangular shape may have a triangular shape, or have a quadrangular shape, an oblique line shape inclined with respect to one side of a quadrangular shape, a bent segment shape, or a rounded corner shape.

The first to third regions A1, A2, and A3 may have pixel regions PXA1, PXA2, and PXA3 (hereinafter, referred to as PXA) (or display regions) and peripheral regions PPA1, PPA2, and PPA3 (hereinafter, referred to as PPA) (or non-display regions), respectively.

The pixel regions PXA are regions in which pixels PXL for displaying an image are provided. Further details of the pixels PXL will be described later with reference to FIG. 4. First to third pixel regions PXA1, PXA2, and PXA3 may roughly have shapes corresponding to the first to third regions A1, A2, and A3, respectively.

The peripheral regions PPA are regions in which the pixels PXL are not provided, and are regions in which the image is not displayed. The driver, the power supply, and some of lines may be provided in the peripheral regions PPA. The peripheral regions PPA may correspond to a bezel (or dead space) of the final display device, and a width of the bezel may be determined based on widths of the peripheral regions PPA.

The first region A1 may have an area largest among the first to third regions A1, A2, and A3. The first region A1 may have the first pixel region PXA1 in which an image is displayed and a first peripheral region PPA1 surrounding at least a portion of the first pixel region PXA1.

The first pixel region PXA1 may be provided in a shape corresponding to that of the first region A1. The first pixel region PXA1 may have a first width W1 in a first direction DR1, and have a first length L1 in a second direction DR2 intersecting the first direction DR1.

The first peripheral region PPA1 may be provided at at least one side of the first pixel region PXA1. The first peripheral region PPA1 surrounds an edge of the first pixel region PXA1, and may be provided at a portion except the second region A2 and the third region A3. The first peripheral region PPA1 may include a lateral part extending in width direction thereof and a longitudinal part extending in the length direction thereof. The longitudinal part of the first peripheral region PPA1 may be provided in a pair spaced apart from each other along the width direction of the first pixel region PXA1 (or the first direction DR1).

The second region A2 may have an area smaller than that of the first region A1. The second region A2 may include the second pixel region PXA2 in which an image is displayed and a second peripheral region PPA2 surrounding at least a portion of the second pixel region PXA2.

The second pixel region PXA2 may be provided in a shape corresponding to that of the second region A2. The second pixel region PXA2 may have a second width W2 smaller than the first width W1 of the first pixel region PXA1. The second pixel region PXA2 may have a second length L2 smaller than the first length L1 of the first pixel region PXA1. The second pixel region PXA2 may be provided in a shape protruding from the first pixel region PXA1, and be connected directly to the first pixel region PXA1. That is, in the second pixel region PXA2, an edge portion closest to the first pixel region PXA1 may correspond to the edge of the first pixel region PXA1.

The second peripheral region PPA2 may be provided at at least one side of the second pixel region PXA2. The second peripheral region PPA2 surrounds the second pixel region PXA2, and may not be provided at a portion at which the first pixel region PXA1 and the second pixel region PXA2 are connected to each other. The second peripheral region PPA2 may also include a lateral part extending in the first direction DR1 and a longitudinal part extending in the second direction DR2. The longitudinal part of the second peripheral region PPA2 may be provided in a pair spaced apart from each other along the first direction DR1.

The third region A3 may have an area smaller than that of the first region A1. The third region A3 may have the third pixel region PXA3 in which an image is displayed and a third peripheral region PPA3 surrounding at least a portion of the third pixel region PXA3.

The third pixel region PXA3 may be provided in a shape corresponding to that of the third region A3. The third pixel region PXA3 may have a width W3 smaller than the first width W1 of the first pixel region PXA1. The third pixel region PXA3 may have a third length L3 smaller than the first length L1 of the first pixel region PXA1. The second width W2 and the third width W3 may be equal to each other. In addition, the second length L2 and the third length L3 may be equal to each other.

The third pixel region PXA3 may be provided in a shape protruding from the first pixel region PXA1, and be connected directly to the first pixel region PXA1. That is, in the third pixel region PXA3, an edge portion closest to the third pixel region PXA3 may correspond to the edge of the first pixel region PXA1.

The third peripheral region PPA3 may be provided at at least one side of the third pixel region PXA3. The third peripheral region PPA3 surrounds the third pixel region PXA3, and may not be provided at a portion at which the first pixel region PXA1 and the third pixel region PXA3 are connected to each other. The third peripheral region PPA3 may also include a lateral part extending in the width direction thereof and a longitudinal part extending in the length direction thereof. The longitudinal part of the third peripheral region PPA3 may be provided in a pair spaced apart from each other along the width direction of the first pixel region PXA1.

According to some example embodiments, the third region A3 may have a shape line-symmetric to the second region A2 with respect to a center line of the first region A1.

The arrangement of components provided in the third region A3 may be substantially identical to that in the second region A2 except some lines.

Therefore, the substrate SUB may have a shape in which the second region A2 and the third region A3 protrude in the second direction DR2 from the first region A1. In addition, the second region A2 and the third region A3 are located to be spaced apart from each other with respect to the first region A1, and hence the substrate SUB may have a shape in which it is depressed between the second region A2 and the third region A3. That is, the substrate SUB may have a notch between the second region A2 and the third region A3.

According to some example embodiments, the longitudinal parts of the first peripheral region PPA1 may be respectively connected to some of the longitudinal parts of the second peripheral region PPA2 and the third peripheral region PPA3. For example, a left longitudinal part of the first peripheral region PPA1 may be connected to a left longitudinal part of the second peripheral region PPA2. A right longitudinal part of the first peripheral region PPA1 may be connected to a right longitudinal part of the third peripheral region PPA3. In addition, the left longitudinal part of the first peripheral region PPA1 and the left longitudinal part of the second peripheral region PPA2 may have the same width W4. The right longitudinal part of the first peripheral region PPA1 and the right longitudinal part of the third peripheral region PPA3 may have the same width W5.

The width W4 of the left longitudinal parts of the first peripheral region PPA1 and the second peripheral region PPA2 may be different from the width W5 of the right longitudinal parts of the first peripheral region PPA1 and the third peripheral region PPA3. For example, the width W4 of the left longitudinal parts of the first peripheral region PPA1 and the second peripheral region PPA2 may be smaller than the width W5 of the right longitudinal parts of the first peripheral region PPA1 and the third peripheral region PPA3.

According to some example embodiments, the second peripheral region PPA2 and the third peripheral region PPA3 may be connected to each other through an additional peripheral region APA. For example, the additional peripheral region APA may connect the right longitudinal part of the second peripheral region PPA2 and the left longitudinal part of the third peripheral region PPA3. That is, the additional peripheral region APA may be provided at a side of the first pixel region PXA1 between the second region A2 and the third region A3.

The pixels PXL may be provided in the pixel regions PXA, that is, the first to third pixel regions PXA1, PXA2, and PXA3 on the substrate SUB. Each of the pixels PXL is a minimum unit for displaying an image, and may be provided in plurality in each of the first to third pixel regions PXA1, PXA2, and PXA3. The pixels PXL may include a display element (or light emitting device) that emits light. For example, the display element may be a liquid crystal display element, an organic light emitting display element, or an inorganic light emitting display element. Hereinafter, for convenience of description, a case where the display element is an organic light emitting display element will be assumed.

Each of the pixels PXL may emit light of one of red, green, and blue, but the present disclosure is not limited thereto. For example, each of the pixels PXL may emit light of a color such as cyan, magenta, yellow, or white.

The pixels PXL may include first pixels PXL1 arranged in the first pixel region PXA1, second pixels PXL2 arranged in the second pixel region PXA2, and third pixels PXL3 arranged in the third pixel region PXA3. According to some example embodiments, each of the first to third pixels PXL1, PXL2, and PXL3 may be arranged in a matrix form along rows extending in the first direction DR1 and columns extending in the second direction DR2. However, the arrangement of the first to third pixels PXL1, PXL2, and PXL3 is not particularly limited, and the first to third pixels PXL1, PXL2, and PXL3 may be arranged in various forms. For example, the first pixels PXL1 may be arranged such that the first direction DR1 becomes the row direction, but the second pixels PXL2 may be arranged such that a direction different from the first direction DR1, for example, a direction oblique to the first direction DR1 becomes the row direction. In addition, it will be apparent that the third pixels PXL3 may be arranged in a direction identical to or different from that of the first pixels PXL1 and/or the second pixels PXL2. For example, the row direction may become the second direction DR2, and the column direction may become the first direction DR1.

According to some example embodiments, in the second region A2 and the third region A3, numbers of second pixels PXL2 and third pixels PXL3 may vary depending on rows. Also, in the second region A2 and the third region A3, lengths of lines may vary depending on columns. This will be described later with reference to FIG. 2.

The driver provides a signal to each pixel PXL through the line part, and accordingly, driving of the pixel PXL can be controlled. In FIG. 1, the line part is omitted for convenience of description. The line part will be described later with reference to FIGS. 3A to 3D.

The driver may include scan drivers SDV1, SDV2, and SDV3 (hereinafter, referred to as SDV) configured to provide a scan signal to each pixel PXL along a scan line, emission drivers EDV1, EDV2, and EDV3 (hereinafter, referred to as EDV) configured to provide an emission control signal to each pixel PXL along an emission control line, a data driver DDV configured to provide a data signal to each PXL along a data line, and a timing controller. The timing controller may control the scan drivers SDV, the emission drivers EDV, and the data driver DDV.

According to some example embodiments, the scan drivers SDV may include a first scan driver SDV1 connected to the first pixels PXL1, a second scan driver SDV2 connected to the second pixels PXL2, and a third scan driver SDV3 connected to the third pixels PXL3. The emission drivers EDV may include a first emission driver EDV1 connected to the first pixels PXL1, a second emission driver EDV2 connected to the second pixels PXL2, and a third emission driver EDV3 connected to the third pixels PXL3.

The first scan driver SDV1 may be located at the longitudinal part in the first peripheral region PPA1. Because the longitudinal part of the first peripheral region PPA1 is provided in a pair spaced apart from each other along the width direction of the first pixel region PXA1, the first scan driver SDV1 may be located at at least one side of the longitudinal part of the first peripheral region PPA1. The first scan driver SDV1 may extend long along the length direction of the first peripheral region PPA1.

Similarly, the second scan driver SDV2 may be located in the second peripheral region PPA2, and the third scan driver SDV3 may be located in the third peripheral region PPA3.

According to some example embodiments, the scan drivers SDV may be directly mounted on the substrate SUB. When the scan drivers SDV are directly mounted on the substrate SUB, the scan drivers SDV may be formed together with the pixels PXL in a process of forming the pixels PXL. However, the mounting position and forming method of the scan drivers SDV are not limited thereto. For example, the scan drivers SDV may be formed in a separate chip to be provided in the form of chip on glass on the substrate SUB. Alternatively, the scan drivers SDV may be mounted on a printed circuit board to be connected to the substrate SUB through a connection member.

Like the first scan driver SDV1, the first emission driver EDV1 may also be located at the longitudinal part of the first peripheral region PPA1. The first emission driver EDV1 may be located at at least one side of the longitudinal part of the first peripheral region PPA1. The first emission driver EDV1 may extend along the length direction of the first peripheral region PPA1.

In a similar manner, the second emission driver EDV2 may be located in the second peripheral region PPA2, and the third emission driver EDV3 may be located in the third peripheral region PPA3.

According to some example embodiments, the emission drivers EDV may be directly mounted on the substrate SUB. When the emission drivers EDV are directly mounted on the substrate SUB, the emission drivers EDV may be formed together with the pixels PXL in the process of forming the pixels PXL. However, the mounting position and forming method of the emission drivers EDV are not limited thereto. For example, the emission drivers EDV may be formed in a separate chip to be provided in the form of chip on glass on the substrate SUB. Alternatively, the emission drivers EDV may be mounted on a printed circuit board to be connected to the substrate SUB through a connection member.

According to some example embodiments, although a case where the scan drivers SDV and the emission drivers EDV are adjacent to each other and are formed at only one side of the pair of longitudinal parts of the peripheral regions PPA is illustrated as an example, the present disclosure is not limited thereto. The arrangement of the scan drivers SDV and the emission drivers EDV may be changed in various manners. For example, the first scan driver SDV1 may be provided at one side of the longitudinal part of the first peripheral region PPA1, and the first emission driver EDV1 may be provided at the other side of the longitudinal part of the first peripheral region PPA1. Alternatively, the first scan driver SDV1 may be provided at both sides of the longitudinal part of the first peripheral region PPA1, and the first emission driver EDV1 may be provided at only one side of the longitudinal part of the first peripheral region PPA1.

The data driver DDV may be located in the first peripheral region PPA1. The data driver DDV may be located at the lateral part of the first peripheral region PPA1. The data driver DDV may extend along the width direction of the first peripheral region PPA1.

According to some example embodiments, the positions of the scan drivers SDV, the emission drivers EDV, and/or the data driver DDV may be changed, if necessary.

The timing controller may be connected, in various manners, to the first to third scan drivers SDV1, SDV2, and SDV3, the first to third emission drivers EDV1, EDV2, and EDV3, and the data driver DDV through lines. The position at which the timing controller is located is not particularly limited. For example, the timing controller may be mounted on a printed circuit board to be connected to the first to third scan drivers SDV1, SDV2, and SDV3, the first to third emission drivers EDV1, EDV2, and EDV3, and the data driver DDV through a flexible printed circuit board. The printed circuit board may be located at various positions such as one side of the substrate SUB and a back side of the substrate SUB.

In addition, one of the second and third scan drivers SDV2 and SDV3 and one of the second and third emission drivers EDV2 and EDV3 may be omitted in a configuration in which scan lines or emission control lines of the second pixels PXL2 and the third pixels PXL3, which correspond to the same row, are electrically connected through a scan line connection part or an emission control line connection part.

The power supply may include at least one VDD and VSS. For example, the power supply may include a first power supply line VDD and a second power supply line VSS. The first power supply line VDD and the second power supply line VSS may supply power to the first pixel PXL1, the second pixel PXL2, and the third pixel PXL3.

One of the first power supply line VDD and the second power supply line VSS, e.g., the first power supply line VDD may be located to correspond to one side of the first peripheral region PPA1. For example, the first power supply line VDD may be located in a region in which the data driver DDV of the first peripheral region PPA1 is located. Also, the first power supply line VDD may extend in the width direction of the first pixel region PXA1.

The other of the first power supply line VDD and the second power supply line VSS, e.g., the second power supply line VSS may be located to surround the first pixel region PXA1, the second pixel region PXA2, and the third pixel region PXA3 except the region in which the data driver DDV of the first peripheral region PPA1 is located. For example, the second power supply line VSS may have a shape extending along the left longitudinal part of the first peripheral region PPA1, the second peripheral region PPA2, the third peripheral region PPA3, the additional peripheral region APA, and the right longitudinal part of the first peripheral region PPA1.

Although a case where the first power supply line VDD is located to correspond to one side of the first pixel region PXA1 in the first peripheral region PPA1 and the second power supply line VSS is located in the other peripheral regions is described as an example, but the present disclosure is not limited thereto. For example, the first power supply line VDD and the second power supply line VSS may be located to surround the first pixel region PXA1, the second pixel region PXA2, and the third pixel region PXA3.

A voltage applied to the first power supply line VDD may be higher than that applied to the second power supply line VSS.

In some embodiments, the display device may further include selectors and load matching capacitors, which are located in a notch region A_N including the additional peripheral region APA. The load matching capacitors may be used to control loads of lines located in the second and third pixel regions PXA2 and PXA3, and the selectors may selectively connect one of the load matching capacitors to at least two lines among the lines.

Figure 2:
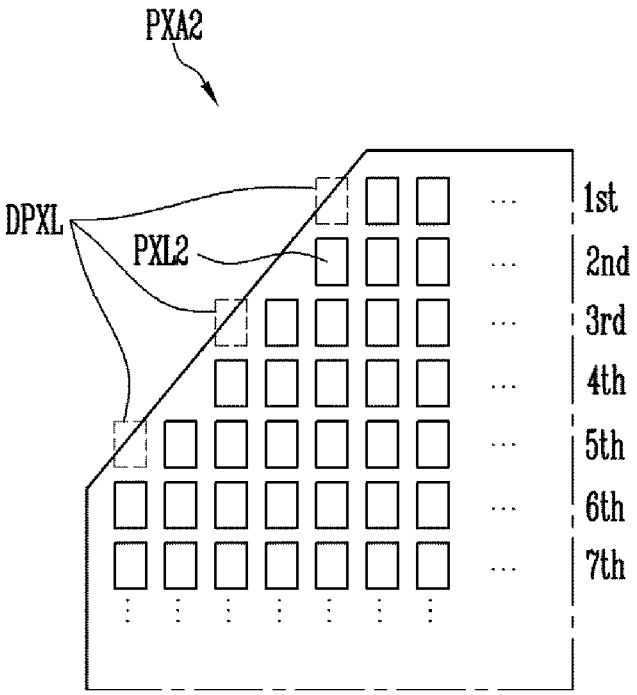
FIG. 2 is a plan view illustrating an example of a second pixel region included in the display device shown in FIG. 1.

FIG. 2 is a plan view illustrating an example of the second pixel region included in the display device shown in FIG. 1.

Referring to FIG. 2, in the second pixel region PXA2, the number of second pixels PXL2 may vary depending on rows. For example, in the second pixel region PXA2, a number of second pixels PXL2 located in a row corresponding to a corner including an oblique side having a slope may be smaller than that of second pixels PXL2 located in a row corresponding to a corner including a linear side. In addition, the number of second pixels PXL2 located in a row may decrease as the length of the row is shortened. Therefore, the length of a line connecting second pixels PXL2 may be shortened.

In some embodiments, the second pixels PXL2 may include dummy pixels DPXL. The dummy pixels DPXL may be pixels that are located at an edge of the second pixel region PXA2 and do not display any image, among the second pixels PXL2.

According to some example embodiments, some of the rows in the second pixel region PXA2 may include the same number of second pixels PXL2. For example, the number of pixels included in a first row may be equal to that of pixels included in a second row. The length and load of a first line (e.g., a first scan line) connected to the pixels of the first row may be substantially equal or similar to those of a second line (e.g., a second scan line) connected to the pixels of the second row. Therefore, the first line may share a load matching capacitor with the second line. Similarly, a third pixel row and a fourth pixel row may include the same number of pixels, and fifth to seventh pixel rows may include the same number of pixels.

That is, lines (e.g., scan lines) corresponding to adjacent rows have lengths equal or similar to each other and loads equal or similar to each other. Therefore, lines may share a load matching capacitor with each other.

FIGS. 3A to 3D are block diagrams illustrating examples of the display device shown in FIG. 1.

Figure 3A:
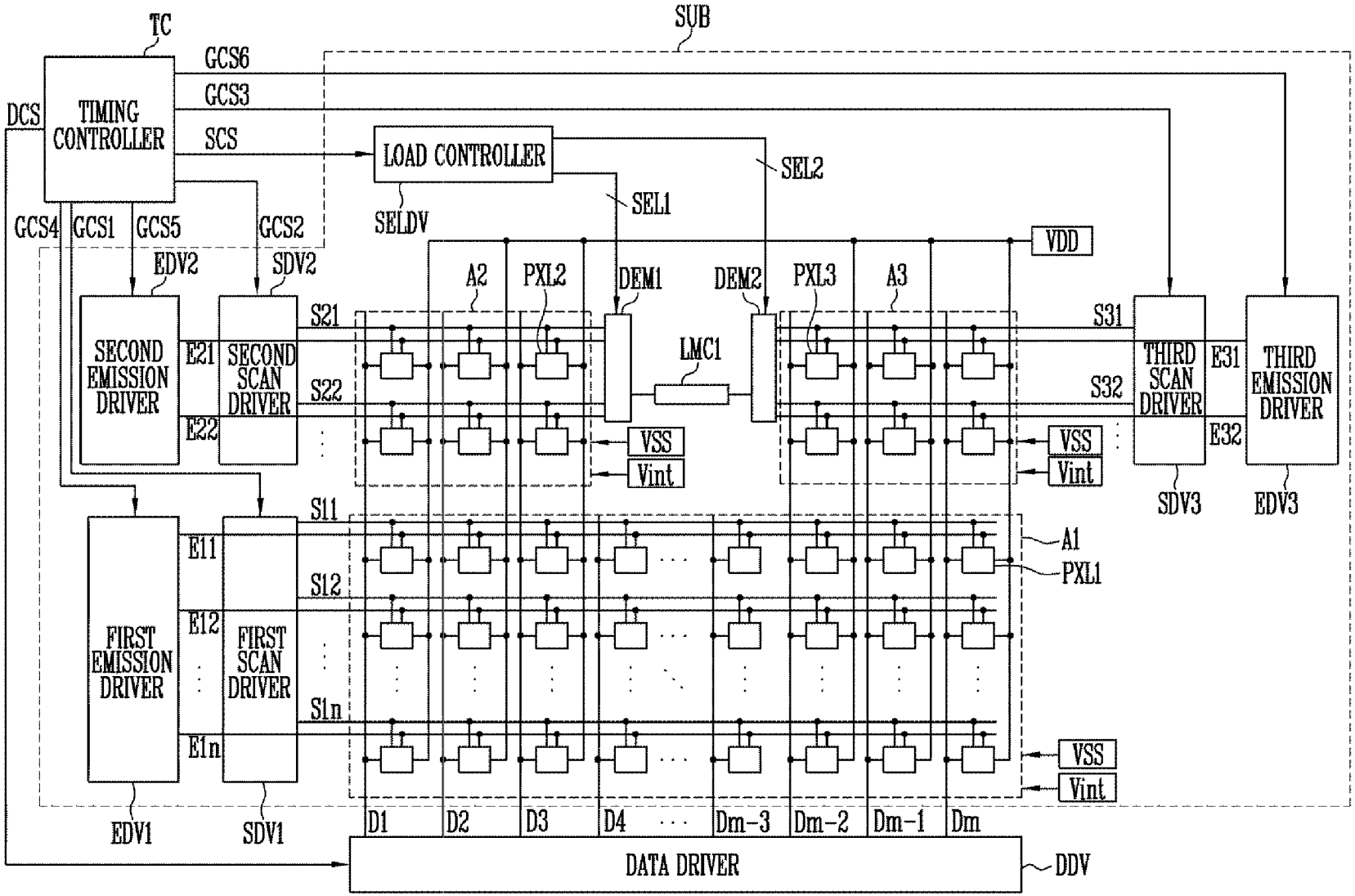
FIGS. 3A to 3D are block diagrams illustrating examples of the display device shown in FIG. 1.

First, referring to FIG. 3A, a display device includes pixels PXL, a driver, and a line part.

The pixels PXL may include first to third pixels PXL1, PXL2, and PXL3, and the driver may include first to third scan drivers SDV1, SDV2, and SDV3, first to third emission drivers EDV1, EDV2, and EDV3, a data driver DDV, and a timing controller TC. Also, the driver may further include a load controller SELDV and selectors DEM1 and DEM2 (or selection circuits).

Positions of the first to third scan drivers SDV1, SDV2, and SDV3, the first to third emission drivers EDV1, EDV2, and EDV3, the data driver DDV, the timing controller TC, and the load controller SELDV are set for convenience of description, and may be variously changed. For example, although the data driver DDV is located at a portion closer to a first pixel region PXA1 than a second pixel region PXA2 and a third pixel region PXA3, the data driver DDV may be located adjacent to the second pixel region PXA2 and the third pixel region PXA3.

The line part provides a signal of the driver to each pixel PXL, and includes gate lines (e.g., scan lines and emission control lines), data lines, a power line, and an initialization power line. Also, the line part may further include a first load matching capacitor LMC1.

The gate lines may be connected to transistors (or gate electrodes of the transistors) provided in the first to third pixels PXL1, PXL2, and PXL3, and the transistors may be turned on in response to a gate signal (e.g., a scan signal or an emission control signal) having a turn-on voltage level, which is transmitted through the gate lines.

The gate lines may include the scan lines and the emission control lines, or the scan lines and the emission control lines may be commonly referred to as the gate lines.

The scan lines may include first to third scan lines S11 to S1*n*, S21, S22, S31, and S32 respectively connected to the first to third pixels PXL1, PXL2, and PXL3, and the emission control lines may include first to third emission control lines E11 to E1*n*, E21, E22, E31, and E32 respectively connected to the first to third pixels PXL1, PXL2, and PXL3. The data lines D1 to Dm and the power line may be connected to the first to third pixels PXL1, PXL2, and PXL3.

The first pixels PXL1 may be located in the first region A1. The first pixels PXL1 may be connected to the first scan lines S11 to S1*n*, the first emission control lines E11 to E1*n*, and the data lines D1 to Dm. Each first pixel PXL1 may receive a data signal from a corresponding data line among the data lines D1 to Dm when a scan signal is supplied from a corresponding first scan line among the first scan lines S11 to S1*n*. The first pixel PXL1 may control an amount of current flowing from a first power supply line VDD to a second power supply line VSS via a light emitting device included therein.

The second pixels PXL2 may be located in the second region A2. The second pixels PXL2 may be connected to the second scan lines S21 and S22, the second emission control lines E21 and E22, and the data lines D1 to D3. Each second pixel PXL2 may receive a data signal from a corresponding data line among the data lines D1 to D3 when a scan signal is supplied from a corresponding scan line among the second scan lines S21 and S22 and the third scan lines S31 and S32.

Although a case where six second pixels PXL2 are located in the second region A2 defined by two second scan lines S21 and S22, two second emission control lines E21 and E22, and three data lines D1 to D3 is illustrated in FIG. 3A, the present disclosure is not limited thereto. That is, a plurality of second pixels PXL2 are arranged corresponding to the size of the second region A2, and numbers of second scan lines, second emission control lines, and data lines may be variously set depending on the number of second pixels PXL2. For example, about 90 second scan lines may be arranged in the second region A2.

The third pixels PXL3 may be located in the third region A3 defined by the third scan lines S31 and S32, the third emission control lines E31 and E32, and the data lines Dm-2 to Dm. Each third pixel PXL3 may receive a data signal from a corresponding data line among the data lines Dm-2 to Dm when a scan signal is supplied from a corresponding scan line among the third scan lines S31 and S32 and the second scan lines S21 and S22.

The load controller SELDV may supply generate first selection signals SEL1 and second selection signals SEL2 based on a selection control signal SCS provided from the timing controller TC.

A first selector DEM1 may select one of the second scan lines S21 and S22 in response to the first selection signals SEL1 and connect the selected one to the first load matching capacitor LMC1. Also, when the first load matching capacitor LMC1 includes a plurality of capacitors, the first selector DEM1 may select one of the capacitors and connect the selected one to one selected from the second scan lines S21 and S22. Similarly, a second selector DEM2 may select one of the third scan lines S31 and S32 in response to the second selection signals SEL2 and connect the selected one to the first load matching capacitor LMC1. Also, when the first load matching capacitor LMC1 includes a plurality of capacitors, the second selector DEM2 may select one of the capacitors and connect the selected one to one selected from the third scan lines S31 and S32.

The first scan driver SDV1 may supply a scan signal to the first scan lines S11 to S1*n* in response to a first gate control signal GCS1 from the timing controller TC. For example, the first scan driver SDV1 may sequentially supply the scan signal to the first scan lines S11 to Sin. When the scan signal is sequentially supplied to the first scan lines S11 to Sin, the first pixels PXL1 may be sequentially selected in units of horizontal lines (or in units of rows).

The second scan driver SDV2 may supply a scan signal to the second scan lines S21 and S22 in response to a second gate control signal GCS2 from the timing controller TC. The scan signal supplied to the second scan lines S21 and S22 may be supplied to the third scan lines S31 and S32 through the first and second selectors DEM1 and DEM2 and the first load matching capacitor LMC1. The second scan driver SDV2 may sequentially supply the scan signal to the second scan lines S21 and S22. When the scan signal is sequentially supplied to the second scan lines S21 and S22, the second pixels PXL2 and the third pixels PXL3 may be sequentially selected in units of horizontal lines.

The third scan driver SDV3 may supply a scan signal to the third scan lines S31 and S32 in response to a third gate control signal GCS3 from the timing controller TC. The scan signal supplied to the third scan lines S31 and S32 may be supplied to the second scan lines S21 and S22 through the first and second selectors DEM1 and DEM2 and the first load matching capacitor LMC1. The third scan driver SDV3 may sequentially supply the scan signal to the third scan lines S31 and S32. When the scan signal is sequentially supplied to the third scan lines S31 and S32, the second pixels PXL2 and the third pixels PXL3 may be sequentially selected in units of horizontal lines.

Meanwhile, because the second scan lines S21 and S22 and the third scan lines S31 and S32 are electrically connected respectively to each other through the first and second selectors DEM1 and DEM2 and the first load matching capacitor LMC1, the scan signal supplied from the second scan driver SDV2 and the scan signal supplied from the third scan driver SDV3 may be supplied to be synchronized with each other.

For example, a scan signal supplied to a first second scan line S21 among the second scan lines from the second scan driver SDV2 may be simultaneously supplied with that supplied to a first third scan line S31 among the third scan lines from the third scan driver SDV3. Similarly, a scan signal supplied to a second second scan line S22 among the second scan lines from the second scan driver SDV2 may be simultaneously supplied with that supplied to a second third scan line S32 among the third scan lines from the third scan driver SDV3.

When a scan signal is supplied to the second scan lines S21 and S22 and the third scan lines S31 and S32 by using the second scan driver SDV2 and the third scan driver SDV3, delay of the scan signal due to RC delay of the second scan lines S21 and S22 and the third scan lines S31 and S32 can be prevented, and accordingly, a desired scan signal can be supplied to the second scan lines S21 and S22 and the third scan lines S31 and S32.

Because the second scan driver SDV2 and the third scan driver SDV3 are driven to be synchronized with each other, the second scan driver SDV2 and the third scan driver SDV3 may be driven by the same gate control signal (GCS). For example, the third gate control signal GCS3 supplied to the third scan driver SDV3 may be set as the same signal as the second gate control signal GCS2.

The first emission driver EDV1 may supply an emission control signal to the first emission control lines E11 to E1*n* in response to a fourth gate control signal GCS4. For example, the first emission driver EDV1 may sequentially supply the emission control signal to the first emission control lines E11 to E1*n*.

The second emission driver EDV2 may supply an emission control signal to the second emission control lines E21 and E22 in response to a fifth gate control signal GCS5. The emission control signal supplied to the second emission control lines E21 and E22 may be supplied to the third emission control lines E31 and E32 through the first and second selectors DEM1 and DEM2 and the first load matching capacitor LMC1. The second emission driver EDV2 may sequentially supply the emission control signal to the second emission control lines E21 and E22.

The third emission driver EDV3 may supply an emission control signal to the third emission control lines E31 and E32 in response to a sixth gate control signal GCSE. The emission control signal supplied to the third emission control lines E31 and E32 may be supplied to the second emission control lines E21 and E22 through the first and second selectors DEM1 and DEM2 and the first load matching capacitor LMC1. The third emission driver EDV3 may sequentially supply the emission control signal to the third emission control lines E31 and E32.

The emission control signal may be set to a gate-off voltage (e.g., a high voltage) such that transistors included in the pixels PXL can be turned off, and the scan signal may be set to a gate-on voltage (e.g., a low voltage) such that the transistors included in the pixels PXL can be turned on.

Because the second emission control lines E21 and E22 and the third emission control lines E31 and E32 are electrically connected respectively to each other by the first and second selectors DEM1 and DEM2 and the first load matching capacitor LMC1, the emission control signal supplied from the second emission driver EDV2 and the emission control signal supplied from the third emission driver EDV3 may be supplied to be synchronized with each other.

For example, an emission control signal supplied to a first second emission control line E21 among the second emission control lines from the second emission driver EDV2 may be simultaneously supplied with that supplied to a first third emission control line E31 among the third emission control lines from the third emission driver EDV3.

When an emission control signal is supplied to the second emission control lines E21 and E22 and the third emission control lines E31 and E32 by using the second emission driver EDV2 and the third emission driver EDV3, delay of the emission control signal due to RC delay of the second emission control lines E21 and E22 and the third emission control lines E31 and E32 can be prevented, and accordingly, a desired emission control signal can be supplied to the second emission control lines E21 and E22 and the third emission control lines E31 and E32.

Additionally, the second emission driver EDV2 and the third emission driver EDV3 are driven to be synchronized with each other, and accordingly can be driven by the same gate control signal (GCS). For example, the sixth gate control signal GCS6 supplied to the third emission driver EDV3 may be set as the same signal as the fifth gate control signal GCS5 supplied to the second emission driver EDV2.

The data driver DDV may supply a data signal to the data lines D1 to Dm in response to a data control signal DCS. The data signal supplied to the data lines D1 to Dm may be supplied to pixels PXL selected by the scan signal.

The timing controller TC may supply, to the scan drivers SDV and the emission drivers EDV, the gate control signals GCS1 to GCS6 generated based on timing signals supplied from the outside. Also, the timing controller TC may supply the data control signal DCS to the data driver DDV.

Each of the gate control signals GCS1 to GCS6 may include a start pulse and clock signals. The start pulse may be used to control a timing of a first scan signal or a first emission control signal. The clock signals may be used to shift the start pulse.

The data control signal DCS may include a source start pulse and clock signals. The source start pulse may be used to control a sampling start time of data. The clock signals may be used to control a sampling operation.

When the display device is sequentially driven, the first scan driver SDV1 may receive the last output signal of the second scan driver SDV2 as a start pulse. Similarly, when the display device is sequentially driven, the first emission driver EDV1 may receive the last output signal of the second emission driver EDV2 as a start pulse.

Figure 3B:
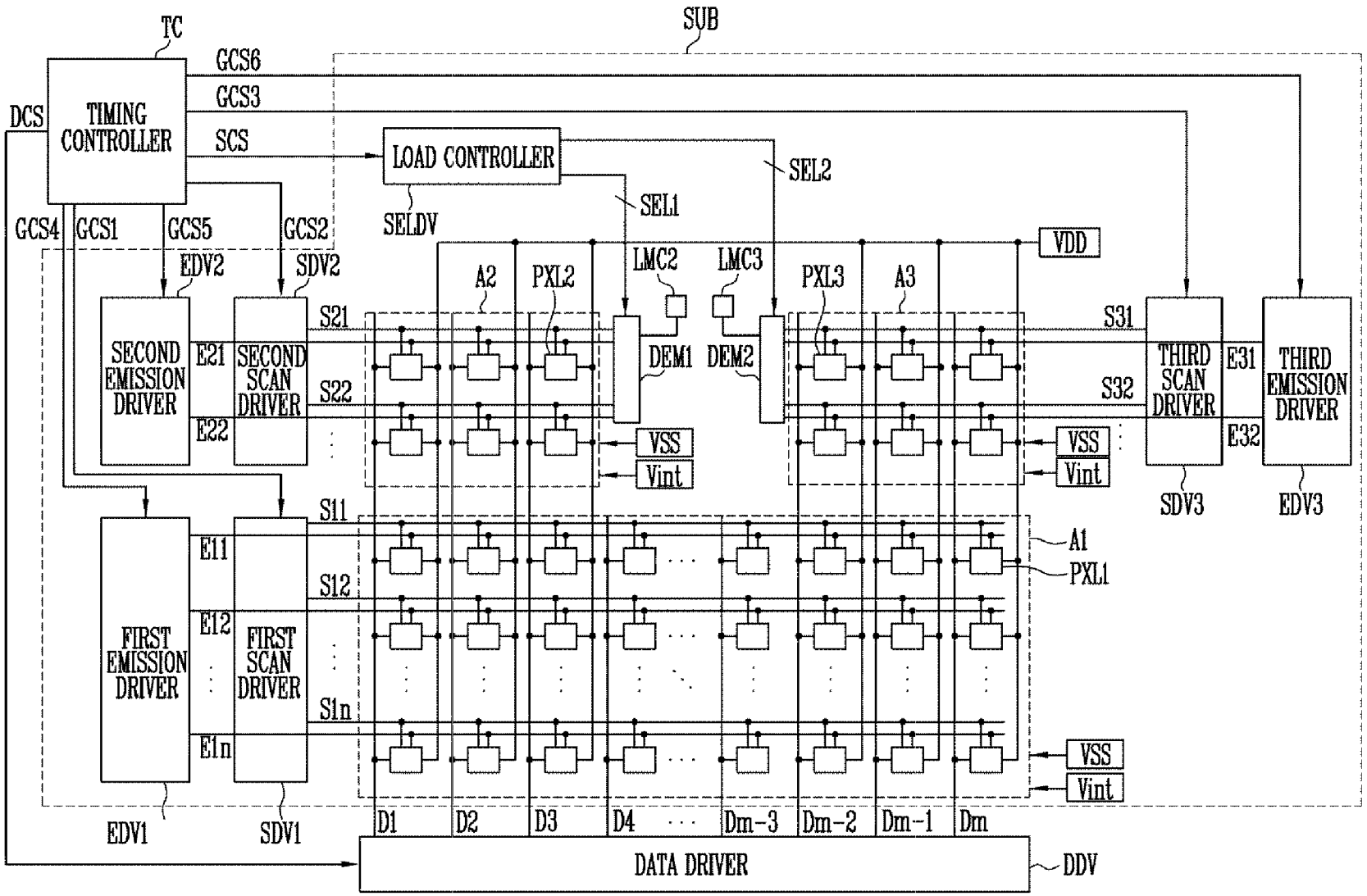

Referring to FIGS. 3A and 3B, a display device shown in FIG. 3B is different from the display device shown in FIG. 3A, in that the display device shown in FIG. 3B includes a second load matching capacitor LMC2 and a third load matching capacitor LMC3. The display device shown in FIG. 3B is substantially identical or similar to the display device shown in FIG. 3A, except the second load matching capacitor LMC2 and the third load matching capacitor LMC3, and therefore, overlapping descriptions will not be repeated.

The second load matching capacitor LMC2 may be connected to the first selector DEM1 (or first selection circuit), and the third load matching capacitor LMC3 may be connected to the second selector DEM2 (or second selection circuit).

The second scan driver SDV2 may supply a scan signal to the second scan lines S21 and S22 in response to the second gate control signal GCS2 from the timing controller TC. The scan signal supplied to the second scan lines S21 and S22 is provided to only the second pixels PXL2, and may not be provided to the third scan lines S31 and S32 and the third pixels PXL3.

Similarly, the third scan driver SDV3 may supply a scan signal to the third scan lines S31 and S32 in response to the third gate control signal GCS3 from the timing controller TC. The scan signal supplied to the third scan lines S31 and S32 is provided to only the third pixels PXL3, and may not be provided to the second scan lines S21 and S22 and the second pixels PXL2.

For example, according to the size and shape of the notch described with reference to FIG. 1, when the first second scan line S21 among the second scan lines S21 and S22, the first load matching capacitor LMC1 described with reference to FIG. 3A, and the first third scan line S31 among the third scan lines S31 and S32 are connected to each other, a total load of the first second scan line S21, the first load matching capacitor LMC1, and the first third scan line S31 may be larger than that of the first scan lines S11 to Sin. Therefore, the load of the second scan lines S21 and S22 may be adjusted by using the second load matching capacitor LMC2, and the load of the third scan lines S31 and S32 may be adjusted by using the third load matching capacitor LMC3 independent from the second load matching capacitor LMC2.

Although a case where all the second scan lines S21 and S22 are connected to the second load matching capacitor LMC2 is illustrated in FIG. 3B, this is merely illustrative, and the present disclosure is not limited thereto. For example, some of the second scan lines S21 and S22 may be connected to the second load matching capacitor LMC2, and the others of the second scan lines S21 and S22 may be connected to the first load matching capacitor LMC1 described with reference to FIG. 3A. A more detailed configuration related to this will be described later with reference to FIG. 5.

Figure 3C:
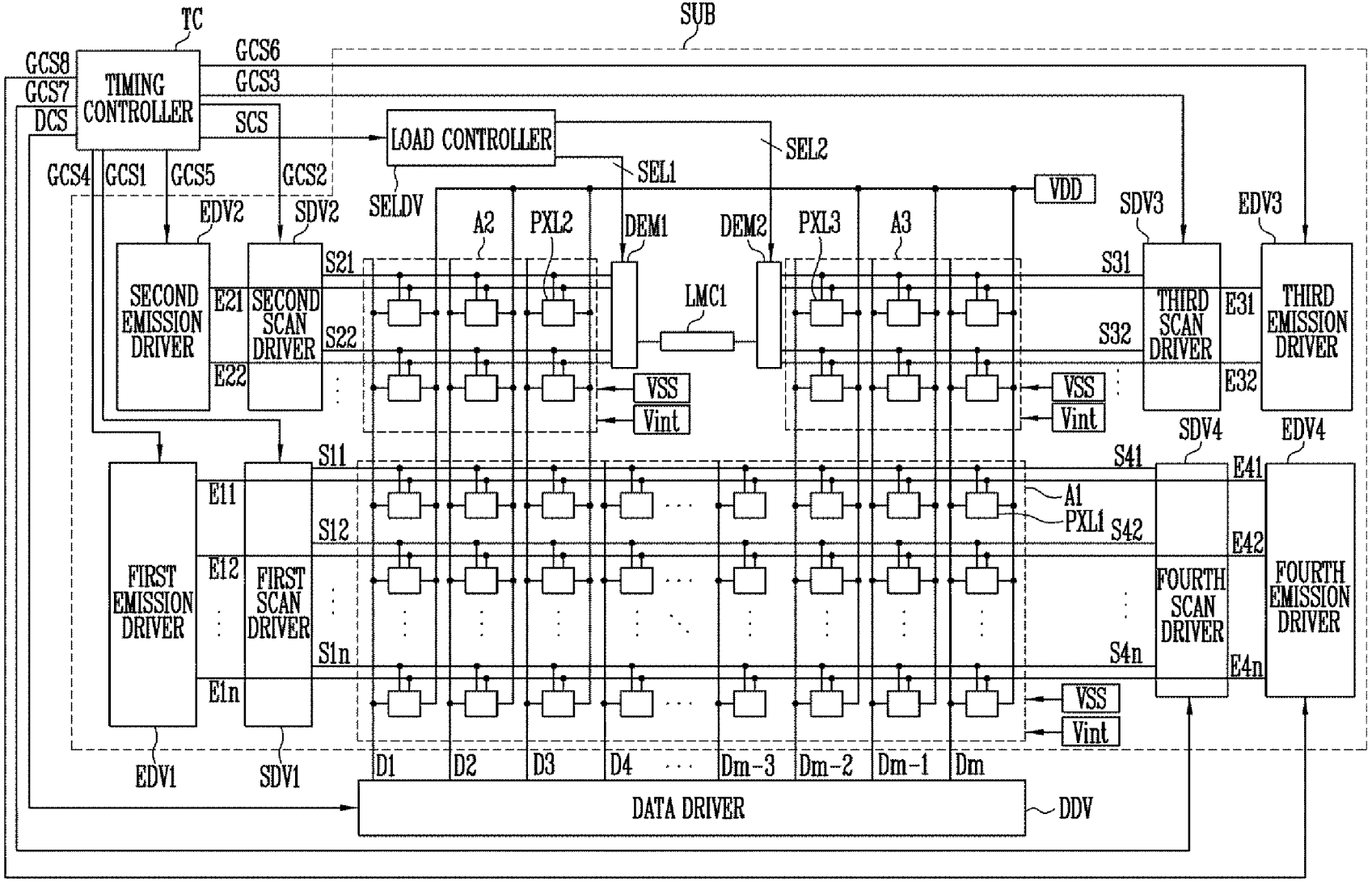

Referring to FIGS. 3A and 3C, a display device shown in FIG. 3C is different from the display device shown in FIG. 3A, in that the display device shown in FIG. 3C further includes a fourth scan driver SDV4 and a fourth emission driver EDV4. The display device shown in FIG. 3C is substantially identical or similar to the display device shown in FIG. 3A, except the fourth scan driver SDV4 and the fourth emission driver EDV4, and therefore, overlapping descriptions will not be repeated.

The fourth scan driver SDV4 and the fourth emission driver EDV4 may be included in the driver.

The fourth scan driver SDV4 may supply a scan signal to the first scan lines S11 to S1*n* (or S41 to S4*n*) in response to a seventh gate control signal GCS7. For example, the fourth scan driver SDV4 may sequentially supply the scan signal to the first scan lines S11 to Sin. When the scan signal is sequentially supplied to the first scan lines S11 to S1*n*, the first pixels PXL1 may be sequentially selected in units of horizontal lines.

The fourth scan driver SDV4 may supply the scan signal to the first scan lines S11 to S1*n* to be synchronized with the first scan driver SDV1. For example, a first scan line S11 among the first scan lines S11 to S1*n* may simultaneously receive a scan signal from the first scan driver SDV1 and the fourth scan driver SDV4.

When a scan signal is supplied to the first scan lines S11 to S1*n* by using the first scan driver SDV1 and the fourth scan driver SDV4, delay of the scan signal due to RC delay of the first scan lines S11 and S1*n* can be prevented, and accordingly, a desired scan signal can be supplied to first scan lines S11 to S1*n*.

The first scan driver SDV1 and the fourth scan driver SDV4 are driven to be synchronized with each other, and accordingly can be driven by the same gate control signal (GCS). For example, the seventh gate control signal GCS7 supplied to the fourth scan driver SDV4 may be set as the same signal as the first gate control signal GCS1. When the display device is sequentially driven, the fourth scan driver SDV4 may receive the last output signal of the third scan driver SDV3 as a start pulse.

The fourth emission driver EDV4 may supply an emission control signal to the first emission control lines E11 to E1*n* (or E41 to E4*n*) in response to an eighth gate control signal GCS8 from the timing controller TC. For example, the fourth emission driver EDV4 may sequentially supply the emission control signal to the first emission control lines E11 to E1*n*.

The fourth emission driver EDV4 may supply an emission control signal to the first emission control lines E11 to E1*n* to be synchronized with the first emission driver EDV1. Thus, delay of the emission control signal due to RC delay of the first emission control lines E11 to E1*n* can be prevented, and accordingly, a desired emission control signal can be supplied to the first emission control lines E11 to E1*n*.

The first emission driver EDV1 and the fourth emission driver EDV4 are driven to be synchronized with each other, and accordingly can be driven by the same gate control signal (GCS). For example, the eighth gate control signal GCS8 supplied to the fourth emission driver EDV4 may be set as the same signal as the fourth gate control signal GCS4 supplied from the first emission driver EDV1. When the display device is sequentially driven, the fourth emission driver EDV4 may receive the last output signal of the third emission driver EDV3 as a start pulse.

Figure 3D:
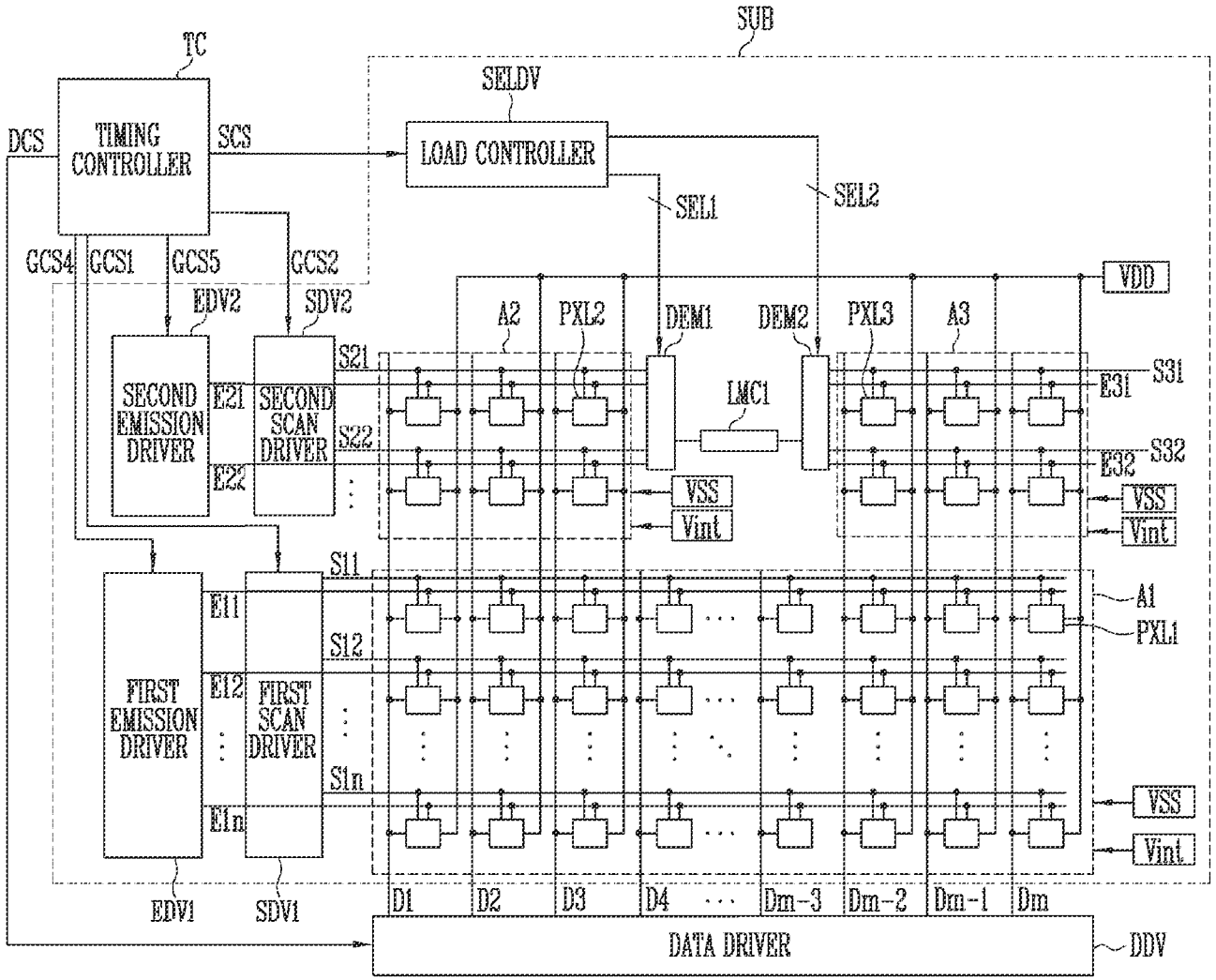

Referring to FIGS. 3A and 3D, a display device shown in FIG. 3D is different from the display device shown in FIG. 3A, in that the display device shown in FIG. 3D does not include the third scan driver SDV3 and the third emission driver EDV3. The display device shown in FIG. 3D is substantially identical or similar to the display device shown in FIG. 3A, except the third scan driver SDV3 and the third emission driver EDV3, and therefore, overlapping descriptions will not be repeated.

The display device may drive the second scan lines S21 and S22 and the third scan lines S31 and S32 by using the second scan driver SDV2, and drive the second emission control lines E21 and E22 and the third emission control lines E31 and E32 by using the second emission driver EDV2.

The second scan lines S21 and S22 and the third scan lines S31 and S32 may be electrically connected respectively to each other through the first selector DEM1, the first load matching capacitor LMC1, and the second selector DEM2, and the second emission control lines E21 and E22 and the third emission control lines E31 and E32 may be electrically connected respectively to each other through the first selector DEM1, the first load matching capacitor LMC1, and the second selector DEM2. Therefore, a scan signal from the second scan driver SDV2 may be supplied to the third scan lines S31 and S32 via the second scan lines S21 and S22, the first selector DEM1, the first load matching capacitor LMC1, and the second selector DEM2. Similarly, an emission control signal from the second emission driver EDV2 may be supplied to the third emission control lines E31 and E32 via the second emission control lines E21 and E22, the first selector DEM1, the first load matching capacitor LMC1, and the second selector DEM2.

As described with reference to FIGS. 3A to 3D, the display device adjusts a load of each of the second scan lines S21 and S22 and the third scan lines S31 and S32 (and/or the second and third emission control lines E21, E22, E31, and E32) by using the first to third load matching capacitors LMC1, LMC2, and LMC3, and enables scan lines corresponding to other rows to share the first to third load matching capacitors LMC1, LMC2, and LMC3 by using the first and second selectors DEM1 and DEM2. Thus, the size (width or area) of a dead space (e.g., the additional peripheral region APA) in which the first to third load matching capacitors LMC1, LMC2, and LMC3 are provided can be decreased.

Figure 4:
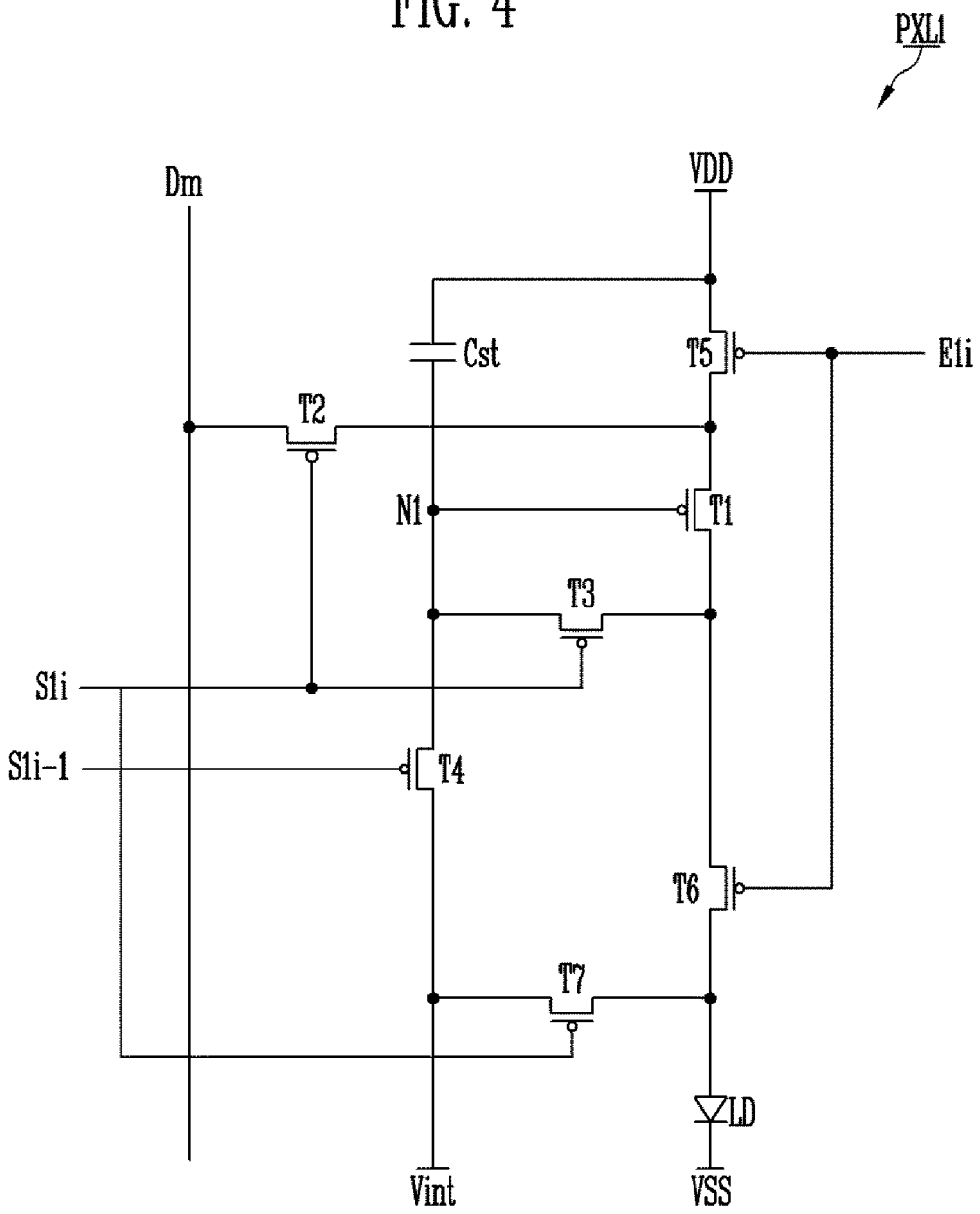
FIG. 4 is a circuit diagram illustrating an example of a pixel included in the display device shown in FIG. 3A.

FIG. 4 is a circuit diagram illustrating an example of the pixel included in the display device shown in FIG. 3A. The first to third pixels PXL1, PXL2, and PXL3 included in the display device shown in FIG. 3A may have circuit structures substantially identical or similar to one another, except positions at which the first to third pixels PXL1, PXL2, and PXL3 are located. Therefore, the first pixel PXL1 will be described in FIG. 4.

Referring to FIG. 4, the first pixel PXL1 may include a light emitting device LD, first to seventh transistors T1 to T7, and a storage capacitor Cst.

An anode of the light emitting device LD may be connected to the first transistor T1 via the sixth transistor T6, and a cathode of the light emitting device LD may be connected to the second power supply line VSS. The light emitting device LD may generate light with predetermined brightness corresponding to an amount of current supplied from the first transistor T1.

A first power source of the first power supply line VDD may be set to a voltage higher than that of a second power source of the second power supply line VSS.

The seventh transistor T7 may be connected between an initialization power source Vint and the anode of the light emitting device LD. A gate electrode of the seventh transistor T7 may be connected to an ith first scan line S1*i*. The seventh transistor T7 may be turned on when a scan signal is supplied to the ith first scan line S1*i*, to supply the voltage of the initialization power source Vint to the anode of the light emitting device LD. The initialization power source Vint may be set to a voltage lower than that of a data signal.

The sixth transistor T6 may be connected between the first transistor T1 and the light emitting device LD. A gate electrode of the sixth transistor T6 may be connected to an ith first emission control line E1*i*. The sixth transistor T6 may be turned off when an emission control signal is supplied to the ith emission control line E1*i*, and may be turned on otherwise.

The fifth transistor T5 may be connected between the first power supply line VDD and the first transistor T1. A gate electrode of the fifth transistor T5 may be connected to the ith emission control line E1*i*. The fifth transistor T5 may be turned off when an emission control signal is supplied to the ith emission control line E1*i*, and may be turned on otherwise.

A first electrode of the first transistor (driving transistor) T1 may be connected to the first power supply line VDD via the fifth transistor T5, and a second electrode of the first transistor T1 may be connected to the anode of the light emitting device LD via the sixth transistor T6. A gate electrode of the first transistor T1 may be connected to a first node N1. The first transistor T1 may control an amount of current flowing from the first power supply line VDD to the second power supply line VSS via the light emitting device LD, corresponding to a voltage of the first node N1.

The third transistor T3 may be connected between the second electrode of the first transistor T1 and the first node N1. A gate electrode of the third transistor T3 may be connected to the ith first scan line S1*i*. The third transistor T3 may be turned on when a scan signal is supplied to the ith first scan line S1*i*, to electrically connect the second electrode of the first transistor T1 to the first node N1. Therefore, the first transistor T1 may be connected in a diode form when the third transistor T3 is turned on.

The fourth transistor T4 may be connected between the first node N1 and the initialization power source Vint. A gate electrode of the fourth transistor T4 may be connected to an (i−1)th first scan line S1*i*-1. The fourth transistor T4 may be turned on when a scan signal is supplied to the (i−1)th first scan line S1*i*-1, to supply the voltage of the initialization power source Vint to the first node N1.

The second transistor T2 may be connected between an mth data line Dm and the first electrode of the first transistor T1. A gate electrode of the second transistor T2 may be connected to the ith first scan line S1*i*. The second transistor T2 may be turned on when a scan signal is supplied to the ith first scan line S1*i*, to electrically connect the mth data line Dm to the first electrode of the first transistor T1.

The storage capacitor Cst may be connected between the first power supply line VDD and the first node N1. The storage capacitor Cst may store a voltage corresponding to the data signal and a threshold voltage of the first transistor T1.

Figure 5:
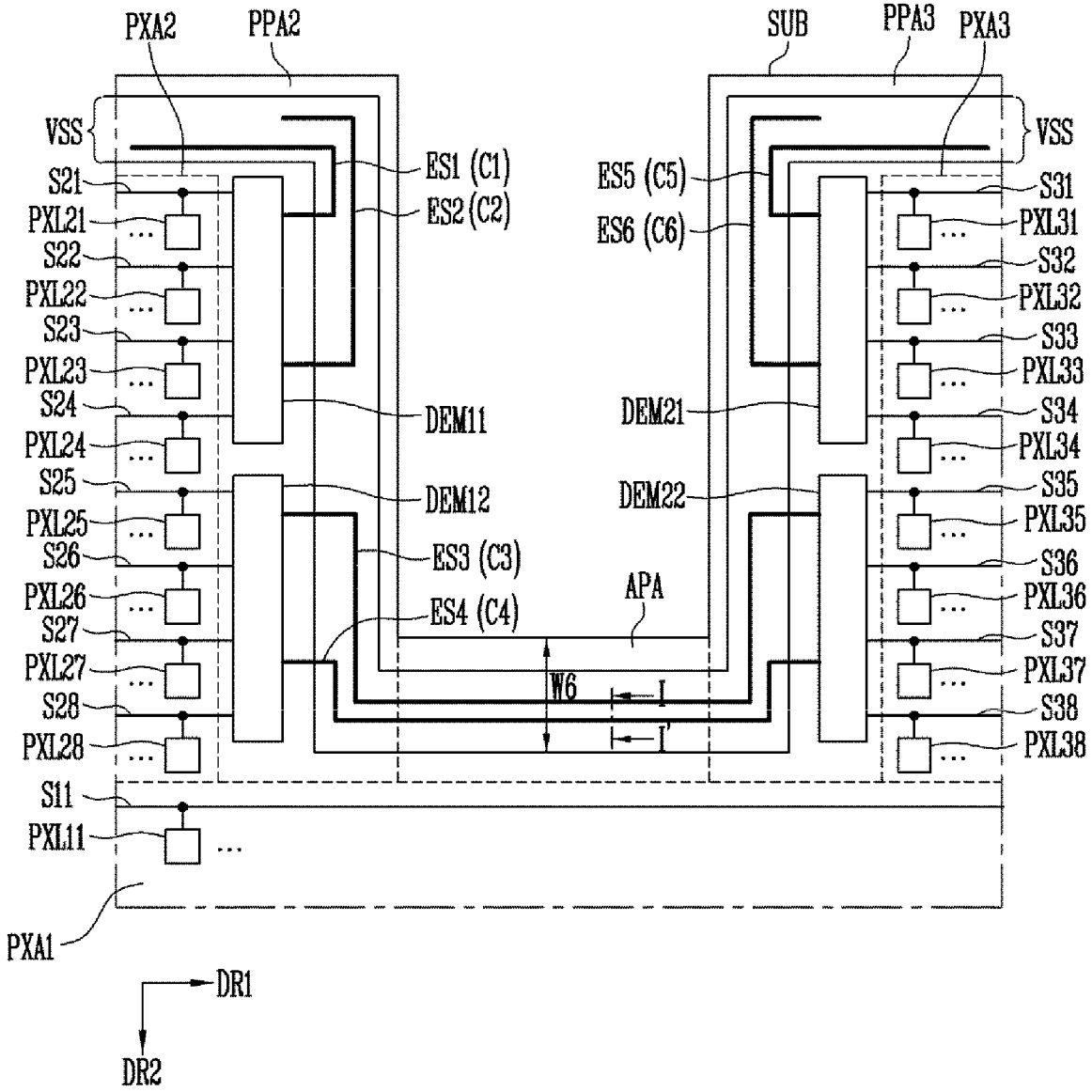
FIG. 5 is a plan view illustrating an example of a notch region included in the display device shown in FIG. 1.

FIG. 5 is a plan view illustrating an example of the notch region included in the display device shown in FIG. 1. The notch region A_N including portions of the first to third regions A1, A2, and A3 with the notch shown in FIG. 1 as the center is illustrated in FIG. 5.

Referring to FIGS. 1 and 5, the display device may include the substrate SUB, pixels PXL11, PXL21 to PXL28, and PXL31 to PXL38, gate lines, first to fourth sub-selectors DEM11, DEM12, DEM21, and DEM22 (or first to fourth selection circuits), connection lines ES1 to ES6 (or capacitors C1 to C6), and the second power supply line VSS. Although a case where the gate lines are scan lines S11, S21 to S28, and S31 to S38 is illustrated for convenience of description, the present disclosure is not limited thereto, and the gate lines may be emission control lines described with reference to FIG. 3A.

The second pixel region PXA2 and the third pixel region PXA3 may be located at one side of the first pixel region PXA1, and the second pixel region PXA2 and the third pixel region PXA3 may be located to be spaced apart from each other in the first direction DR1. The second peripheral region PPA2 may be located along an edge of the second pixel region PXA2, the third peripheral region PPA3 may be located along an edge of the third pixel region PXA3, and the additional peripheral region APA may be located along an edge of the first pixel region PXA1 between the second pixel region PXA2 and the third pixel region PXA3. The second peripheral region PPA2, the third peripheral region PPA3, and the additional peripheral region APA may be commonly referred to as non-pixel regions.

The pixels PXL11, PXL21 to PXL28, and PXL31 to PXL38 may be respectively provided or located in the first to third pixel regions PXA1, PXA2, and PXA3 of the substrate SUB.

A first scan line S11 may be located in the first pixel region PXA1, extend along the first direction DR1, and be connected to first pixels (e.g., a first pixel PXL11).

Second scan lines S21 to S28 may be located in the second pixel region PXA2, extend along the first direction DR1, and be connected to second pixels PXL21 to PXL28. For example, a first scan line S21 among second gate lines may be connected to a first pixel PXL21 among the second pixels, and a second scan line S22 among the second gate lines may be connected to a second pixel PXL22 among the second pixels.

As described with reference to FIGS. 1 to 3D, the second scan lines S21 to S28 may have a load (or load value) different from that of the first scan line S11. This is because a pixel number in the second pixel region PXA2 and a length of each of the second scan lines S21 to S28 are different from a pixel number in the first pixel region PXA1 and a length of the first scan line S11.

In addition, as described with reference to FIG. 2, some of the second scan lines S21 to S28 may have loads (or load values) different from each other, and other some (e.g., two gate lines adjacent to each other) among the second scan lines S21 to S28 may have loads equal or similar to each other. This is because pixel numbers in the second pixel region PXA2 and lengths of the scan lines are different depending on rows.

Although a case where the second scan lines S21 to S28 include eight gate lines is illustrated in FIG. 5, this is illustrated as an example for convenience of description, and the present disclosure is not limited thereto. For example, the second scan lines S21 to S28 may include about 90 gate lines.

Third scan lines S31 to S38 may be located in the third pixel region PXA3, extend along the first direction DR1, and may be connected to third pixels PXL31 to PXL38. For example, a first scan line S31 among third gate lines may be connected to a first pixel PXL31 among the third pixels, and a second scan line S32 among the third gate lines may be connected to a second pixel PXL32 among the third pixels.

The third scan lines S31 to S38 may have a load (or load value) different from that of the first scan line S11. In addition, some of the third scan lines S31 to S38 may have loads (or load values) different from each other, and other some (e.g., two gate lines adjacent to each other) of the third scan lines S31 to S38 may have a load equal or similar to each other.

As described with reference to FIG. 1, the second power supply line VSS may be located via the second peripheral region PPA2, the third peripheral region PPA3, and the additional peripheral region APA, and surround the first to third pixel regions PXA1, PXA2, and PXA3. Although a case where the second power supply line VSS is located in the notch region A_N is illustrated in FIG. 3, this is merely illustrative, and the first power supply line VDD may be located instead of the second power supply line VSS.

The connection lines ES1 to ES6 may be located in at least a portion (or non-pixel region) of the second peripheral region PPA2, the third peripheral region PPA3, and the additional peripheral region APA.

For example, first and second connection lines ES1 and ES2 may be located via only the second peripheral region PPA2, third and fourth connection lines ES3 and ES4 may be located via the second peripheral region PPA2, the additional peripheral region APA, and the third peripheral region PPA3, and fifth and sixth connection lines ES5 and ES6 may be located via only the third peripheral region PPA3.

Each of the first to sixth connection lines ES1 to ES6 may be located to partially overlap with the second power supply line VSS, to form first to sixth capacitors C1 to C6 (or parasitic capacitors). The first to sixth capacitors C1 to C6 will be described later with reference to FIG. 6.

The first to sixth capacitors C1 to C6 may have different capacitances depending on a portion of each of the first to sixth connection lines ES1 to ES6, which overlaps with the second power line VSS. For example, the third connection line ES3 having a relatively large (or long) portion overlapping with the second power supply line VSS may have a capacitance larger than that of the fourth connection line ES4. However, the present disclosure is not limited thereto, and the capacitance of the fourth connection line ES4 may be larger than that of the third connection line ES3 when the fourth connection line ES4 has a relatively large width.

The first to sixth capacitors C1 to C6 may be used to adjust loads of the second scan lines S21 to S28 and loads of the third scan lines S31 to S38. In addition, each of the first to sixth capacitors C1 to C6 may be shared by at least two (i.e., gate lines having loads similar to each other) of the second scan lines S21 to S28 and/or at least two (i.e., gate lines having loads similar to each other) of the third scan lines S31 to S38.

The first sub-selector DEM11 and the second sub-selector DEM12 may be included in the first selector DEM1 described with reference to FIGS. 3A and 3B, and the third sub-selector DEM21 and the fourth sub-selector DEM22 may be included in the second selector DEM2 described with reference to FIGS. 3A and 3B.

The first sub-selector DEM11 (or first selection circuit) may select one of second scan lines S21 to S24 corresponding to first to fourth rows and connect the selected one to the first connection line ES1 (or first capacitor C1). For example, in a first section, the first sub-selector DEM11 may connect a first scan line S21 among the second scan lines S21 to S24 to the first connection line ES1. In a second section different from the first section, the first sub-selector DEM11 may connect a second scan line S22 among the second scan lines S21 to S24 to the first connection line ES1.

Similarly, the first sub-selector DEM11 (or first selection circuit) may select one of the second scan lines S21 to S24 corresponding to the first to fourth rows and connect the selected one to the second connection line ES2 (or second capacitor C2). For example, in a third section, the first sub-selector DEM11 may connect a third scan line S23 among the second scan lines S21 to S24 to the second connection line ES2. In a fourth section different from the third section, the first sub-selector DEM11 may connect a fourth scan line S24 among the second scan lines S21 to S24 to the second connection line ES2.

The second sub-selector DEM12 (or second selection circuit) may select one of second scan lines S25 to S28 corresponding to fifth to eighth rows and connect the selected one to the third connection line ES3 (or third capacitor C3) or the fourth connection line ES4 (or fourth capacitor C4).

Similarly, the third sub-selector DEM21 (or third selection circuit) may select one of third scan lines S31 to S34 corresponding to the first to fourth rows and connect the selected one to the fifth connection line ES5 (or fifth capacitor C5) or the sixth connection line ES6 (or sixth capacitor C6).

Similarly, the fourth sub-selector DEM22 (or fourth selection circuit) may select one of third scan lines S35 to S38 corresponding to the fifth to eighth rows and connect the selected one to the third connection line ES3 (or third capacitor C3) or the fourth connection line ES4 (or fourth capacitor C4).

In some embodiments, the second scan lines S25 to S28 corresponding to the fifth to eighth rows may be respectively connected to the third scan lines S35 to S38 corresponding to the fifth to eighth rows through the second sub-selector DEM12, the third and fourth connection lines ES3 and ES4, and the fourth sub-selector DEM 22. In an example, in the first section, the second sub-selector DEM12 may connect a fifth scan line S25 among the second gate lines to the third connection line ES3, and the fourth sub-selector DEM22 may connect a fifth scan line S35 among the third gate lines to the third connection line ES3. Thus, a scan signal provided through the second scan driver SDV2 and the third scan driver SDV3, which are described with reference to FIG. 3A, is provided to the scan lines S25 and S35 corresponding to the fifth row, and a total load of the scan lines S25 and S35 is adjusted to be equal to a load of the first scan line S11.

In another example, in the second section different from the first section, the second sub-selector DEM12 may connect a sixth scan line S26 among the second gate lines to the third connection line ES3, and the fourth sub-selector DEM22 may connect a sixth scan line S36 among the third gate lines to the third connection line ES3.

As described with reference to FIG. 5, the display device adjusts a load of each of the second scan lines S21 to S28 and the third scan lines S31 to S38 by using the first to sixth connection lines ES1 to ES6 (or first to sixth capacitors C1 to C6), and enables gate lines corresponding to other rows to share the first to sixth connection lines ES1 to ES6 by using the first to fourth sub-selectors DEM11, DEM12, DEM21, and DEM22.

Thus, as compared with a display device configured to connect the second scan lines S21 to S28 and the third scan lines S31 to S38 through the same number of connection lines, the display device shown in FIG. 5 can decrease, by 50% or more, the size (or area) of a non-pixel region (e.g., the width W6 of the additional peripheral region APA), in which the connection lines ES1 to ES6 are located.

Figure 6:
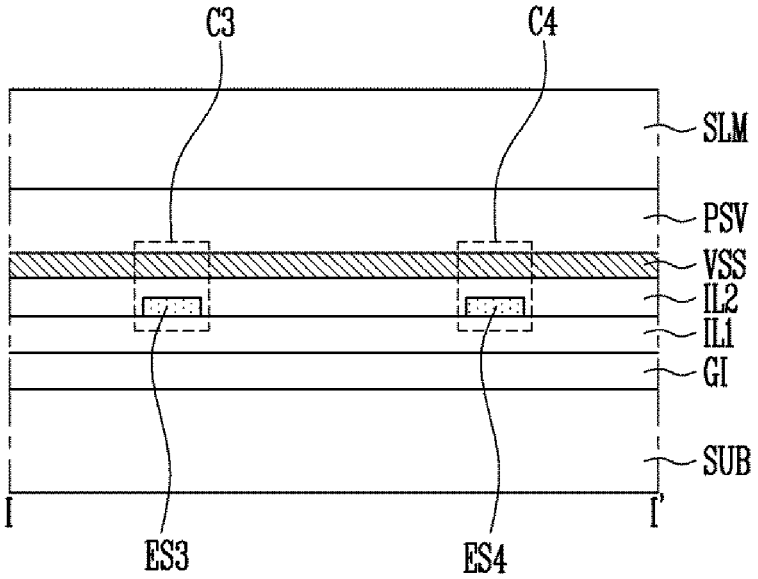
FIG. 6 is a sectional view illustrating an example of the display device taken along the line I-I' shown in FIG. 5.

FIG. 6 is a sectional view illustrating an example of the display device taken along line I-I' shown in FIG. 5.

Referring to FIG. 6, the display device may include a plurality of insulating layers GI, IL1, and IL2, a protective layer PSV, and an encapsulation layer SLM, which are sequentially stacked on the substrate SUB.

The second power supply line VSS described with reference to FIG. 5 may be located between the protective layer PSV and a second interlayer insulating layer IL2 among the insulating layers GI, IL1, and IL2. The connection lines ES1 to ES6 described with reference to FIG. 5 may be located between the insulating layers GI, IL1, and IL2. For example, as shown in FIG. 6, the third and fourth connection lines ES3 and ES4 may be located between a first interlayer insulating layer IL1 and the second interlayer insulating layer IL2.

The third capacitor C3 may be formed at a portion at which the second power supply line VSS and the third connection line ES3 overlap with each other, and the fourth capacitor C4 may be formed at a portion at which the second power supply line VSS and the fourth connection line ES4 overlap with each other.

Meanwhile, although a case where the second power supply line VSS is located between the second interlayer insulating layer IL2 and the protective layer PSV is illustrated in FIG. 6, the present disclosure is not limited thereto. For example, the display device may further include a conductive pattern located between a gate insulating layer GI and the first interlayer insulating layer IL1 among the insulating layers GI, IL1, and IL2. The conductive pattern may be connected to the second power supply line VSS through a separate contact hole. Also, the conductive pattern may form parasitic capacitors by overlapping with the third and fourth connection lines ES3 and ES4. In addition, the portions at which the conductive pattern overlaps with the first to sixth connection lines ES1 to ES6 may vary depending on the shape of the conductive pattern (i.e., the shape of the conductive pattern in a plan view), and accordingly, loads of the first to sixth connection lines ES1 to ES6 may be variously set.

Figure 7:
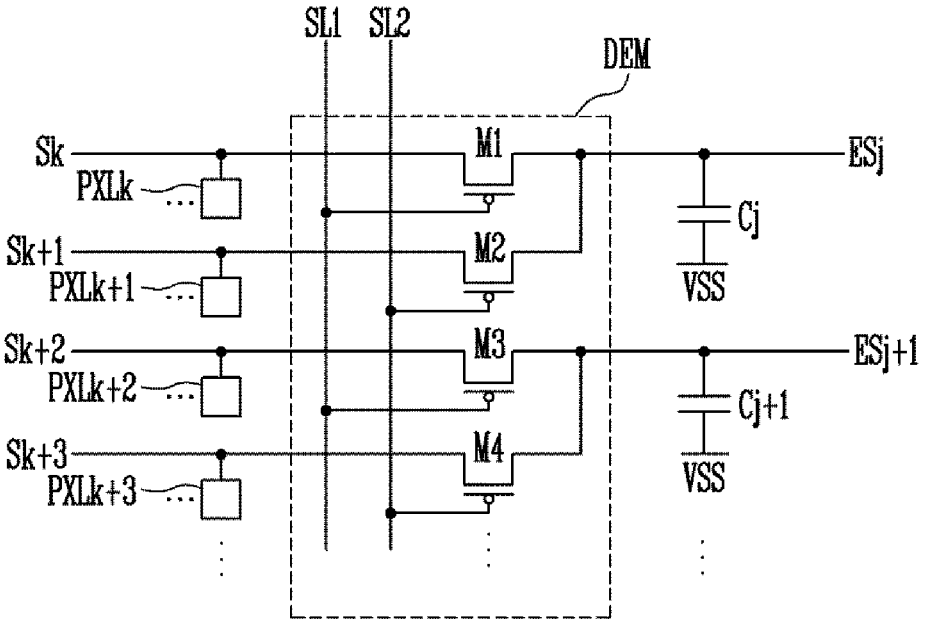
FIG. 7 is a circuit diagram illustrating an example of a selector included in the display device shown in FIG. 5.

FIG. 7 is a circuit diagram illustrating an example of a selector included in the display device shown in FIG. 5. The first to fourth sub-selectors DEM11, DEM12, DEM21, and DEM22 shown in FIG. 5 may be substantially identical or similar to one another, except their arrangement positions. Hereinafter, a selector DEM will be described, including the first to fourth sub-selectors DEM11, DEM12, DEM21, and DEM22.

Referring to FIGS. 5 and 7, the display device may further include selection lines SL1 and SL2. The selection lines SL1 and SL2 may be connected to the load controller SELDV described with reference to FIG. 3A, and transmit selection signals.

The selector DEM may include switching elements M1, M2, M3, and M4. As shown in FIG. 7, the selector DEM may include first to fourth switching elements M1, M2, M3, and M4, and the first to fourth switching elements M1, M2, M3, and M4 may be implemented with a P-type transistor. However, this is merely illustrative. The selector DEM may include five or more switching elements, and at least some of the switching elements may be implemented with an N-type transistor.

The first switching element M1 may include a first electrode connected to a kth (k is a positive integer) scan line Sk, a second electrode connected to a jth (j is a positive integer) connection line ESj (or jth capacitor Cj), and a gate electrode connected to a first selection line SL1. kth to (k+3)th scan lines Sk to Sk+3 may be connected to kth to (k+3)th pixels PXLk to PXLk+3 corresponding to kth to (k+3)th rows, respectively.

The first switching element M1 may connect the kth scan line Sk to the jth connection line ESj (or jth capacitor Cj) in response to a first selection signal transmitted through the first selection line SL1.

The second switching element M2 may include a first electrode connected to the (k+1)th scan line Sk+1, a second electrode connected to the jth connection line ESj (or jth capacitor Cj), and a gate electrode connected to a second selection line SL2. The second switching element M2 may connect the (k+1)th scan line Sk+1 to the jth connection line ESj (or jth capacitor Cj) in response to a second selection signal transmitted through the second selection line SL2.

Similarly to the first switching element M1, the third switching element M3 may be connected between the (k+2) th scan line Sk+2 and a (j+1)th connection line ESj+1 (or (j+1)th capacitor Cj+1), and connect the (k+2)th scan line Sk+2 to the (j+1)th connection line ESj+1 in response to the first selection signal transmitted through the first selection line SL1.

Similarly to the second switching element M2, the fourth switching element M4 may be connected between the (k+3) th scan line Sk+3 and the (j+1)th connection line ESj+1 (or (j+1)th capacitor Cj+1), and connect the (k+3)th scan line Sk+3 to the (j+1)th connection line ESj+1 in response to the second selection signal transmitted through the second selection line SL2.

Although a case where two gate lines share one capacitor is illustrated in FIG. 7, this is merely illustrative, and the present disclosure is not limited thereto.

Figure 8:
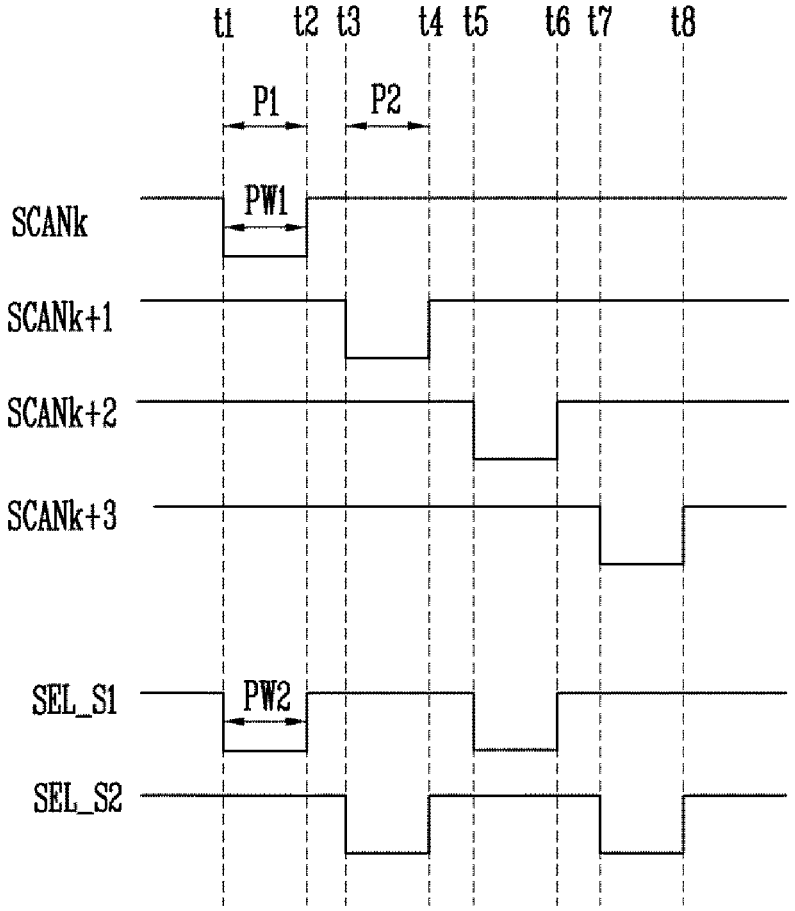
FIG. 8 is a waveform diagram illustrating an example of signals measured in the selector shown in FIG. 7.

FIG. 8 is a waveform diagram illustrating an example of signals measured in the selector shown in FIG. 7.

Referring to FIGS. 7 and 8, at a first time t1 (or at a first time point), a kth scan signal SCANk transmitted to the kth scan line Sk may be changed from a turn-off voltage level (or logic high level) to a turn-on voltage level (or logic low level). A switching transistor (e.g., the second transistor T2 described with reference to FIG. 4) of a kth pixel PXLk may be turned on in response to the kth scan signal SCANk having the turn-on voltage level. Therefore, the kth pixel PXLk may be selected, or a data signal may be recorded in the kth pixel PXLk.

Also, at the first time t1, a first selection signal SEL_S1 transmitted through the first selection line SL1 may be changed to the turn-on voltage level. The first switching element M1 of the selector DEM may be turned on in response to the first selection signal SEL_S1 having the turn-on voltage level, and the kth scan line Sk and the jth connection line ESj (or jth capacitor Cj) may be connected to each other. Accordingly, a load of the kth scan line Sk transmitting the kth scan signal SCANk having the turn-on voltage level can be adjusted or compensated by the jth capacitor Cj.

At a second time t2, each of the kth scan signal SCANk and the first selection signal SEL_S1 may be changed to the turn-off voltage level. A pulse width PW1 of the kth scan signal SCANk may be equal to that PW2 of the first selection signal SEL_S1, but the present disclosure is not limited thereto. For example, the pulse width PW2 of the first selection signal SEL_S1 may be wider than that PW1 of the kth scan signal SCANk.

At a third time t3, a (k+1)th scan signal SCANk+1 transmitted to the (k+1)th scan line Sk+1 may be changed to the turn-on voltage level. A (k+1)th pixel PXLk+1 may be selected in response to the (k+1)th scan signal SCANk+1 having the turn-on voltage level, or a data signal may be recorded in the (k+1)th pixel PXLk+1.

Also, at the third time t3, a second selection signal SEL_S2 transmitted through the second selection line SL2 may be changed to the turn-on voltage level. The second switching element M2 of the selector DEM may be turned on in response to the second selection signal SEL_S2 having the turn-on voltage level, and the (k+1)th scan line Sk+1 and the jth connection line ESj (or jth capacitor Cj) may be connected to each other. Accordingly, a load of the (k+1)th scan line Sk+1 transmitting the (k+1)th scan signal SCANk+1 having the turn-on voltage level can be adjusted or compensated by the jth capacitor Cj.

At a fourth time t4, each of the (k+1)th scan signal SCANk+1 and the second selection signal SEL_S2 may be changed to the turn-off voltage level. A pulse width of the second selection signal SEL_S2 may be equal to that PW2 of the first selection signal SEL_S1.

A second section P2 (i.e., the second section P2 from the third time t3 to the fourth time t4) in which the second switching element M2 is turned on may not overlap with a first section P1 (i.e., the first section P1 from the first time t1 to the second time t2) in which the first switching element M1 is turned on.

A (k+2)th scan signal SCANk+2 (i.e., the (k+2)th scan signal SCANk+2 transmitted to the (k+2)th scan line Sk+2), a (k+3)th scan signal SCANk+3 (i.e., the (k+3)th scan signal SCANk+3 transmitted to the (k+3)th scan line Sk+3), the first selection signal SEL_S1, and the second selection signal SEL_S2 between fifth to eighth times t5 to t8 are substantially identical to the kth scan signal SCANk, the (k+1)th scan signal SCANk+1, the first selection signal SEL_S1, and the second selection signal SEL_S2 between the first to fourth times t1 to t4, and therefore, overlapping descriptions will not repeated.

Between the fifth to eighth times t5 to t8, a load of the (k+2)th scan line Sk+2 can be adjusted by the (j+1)th capacitor Cj+1 according to an operation of the third switching element M3, and a load of the (k+3)th scan line Sk+3 can be adjusted by the (j+1)th capacitor Cj+1 according to an operation of the fourth switching element M4.

Figure 9:
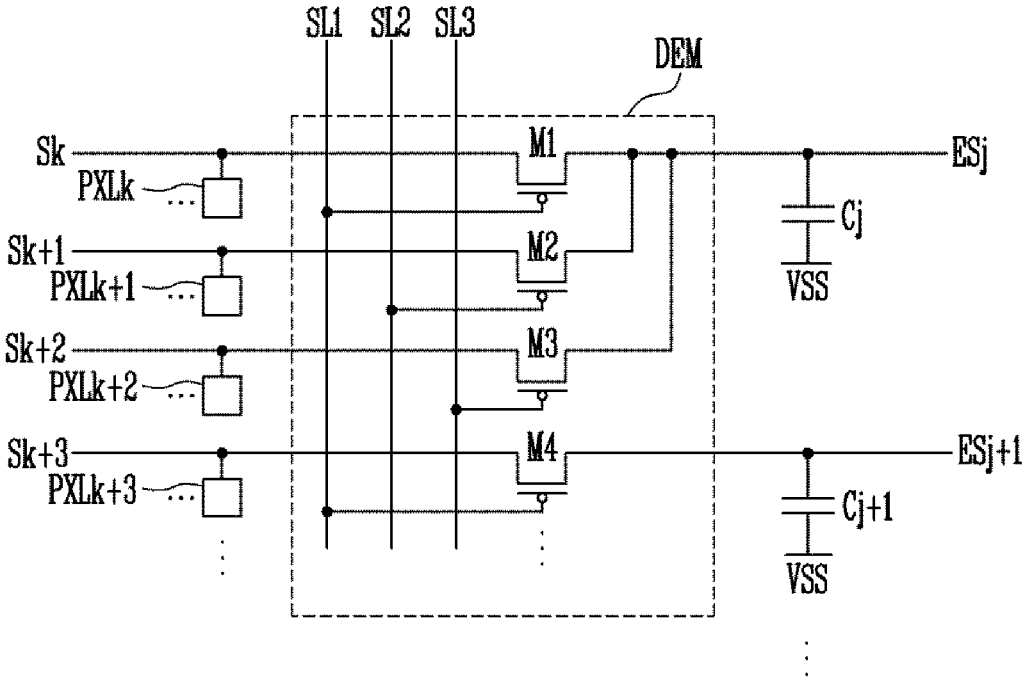
FIG. 9 is a circuit diagram illustrating another example of the selector included in the display device shown in FIG. 5.

FIG. 9 is a circuit diagram illustrating another example of the selector included in the display device shown in FIG. 5.

Referring to FIGS. 5, 7, and 9, a selector DEM shown in FIG. 9 is different from the selector DEM shown in FIG. 7, in that the selector DEM shown in FIG. 9 selects one of the kth to (k+2)th scan lines Sk, Sk+1, and Sk+2 and connects the selected one to the jth connection line ESj (or jth capacitor Cj). The selector DEM shown in FIG. 9 is substantially identical or similar to the selector DEM shown in FIG. 7, except a configuration in which the (k+2)th scan line Sk+2 is connected to the jth capacitor Cj, and therefore, overlapping descriptions will not be repeated.

The display device may further include a third selection line SL3. The third selection line SL3 may be connected to the load controller SELDV described with reference to FIG. 3A, and transmit a third selection signal.

The third switching element M3 may include a first electrode connected to the (k+2)th scan line Sk+2, a second electrode connected to the jth connection line ESj (or jth capacitor Cj), and a gate electrode connected to the third selection line SL3. The third switching element M3 may connect the (k+2)th scan line Sk+2 to the jth connection line ESj (or jth capacitor Cj) in response to the third selection signal transmitted through the third selection line SL3.

A section in which the third selection signal has the turn-on voltage level may not overlap with the first section P1 (see FIG. 8) in which the first selection signal has the turn-on voltage level and the second section P2 (see FIG. 8)

in which the second selection signal has a turn-on voltage level. This is because, when the first to third selection signals overlap with one another, an unwanted pixel may be selected.

As described with reference to FIG. 9, three gate lines may share one capacitor, and four or more gate lines may share one capacitor.

Figure 10:
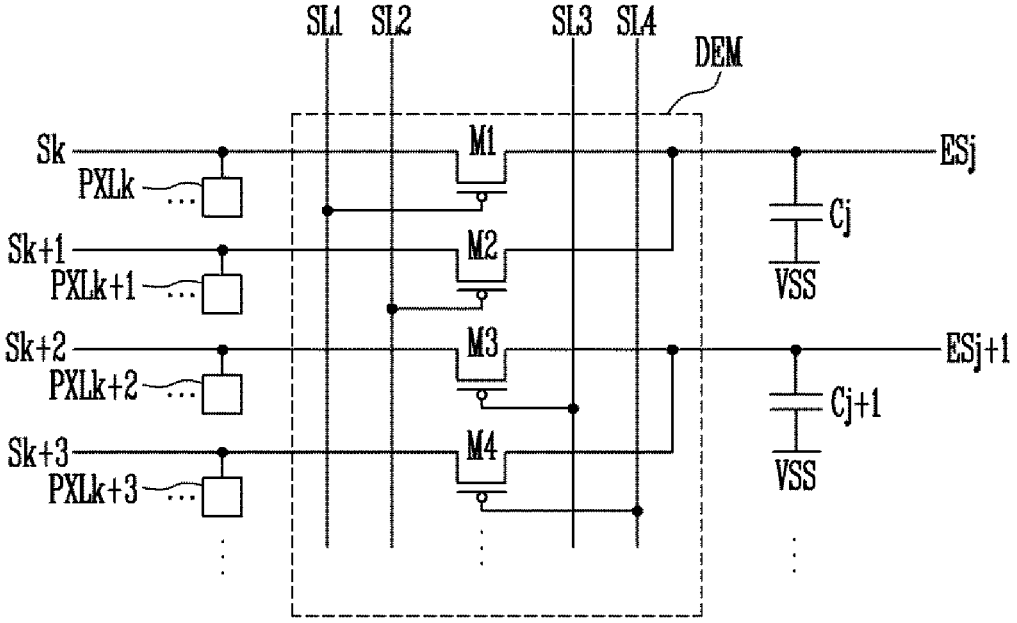
FIG. 10 is a circuit diagram illustrating still another example of the selector included in the display device shown in FIG. 5.

FIG. 10 is a circuit diagram illustrating still another example of the selector included in the display device shown in FIG. 5.

Referring to FIGS. 5, 7, and 10, a selector DEM shown in FIG. 10 is substantially identical or similar to the selector DEM shown in FIG. 7, except a connection configuration of the third and fourth switching elements M3 and M4, and therefore, overlapping descriptions will not be repeated.

The display device may further include third and fourth selection lines SL3 and SL4. The third and fourth selection lines SL3 and SL4 may be connected to the load controller SELDV described with reference to FIG. 3A, and respectively transmit a third selection signal and a fourth selection signal.

The third switching element M3 may include a first electrode connected to the (k+2)th scan line Sk+2, a second electrode connected to the (j+1)th connection line ESj+1 (or (j+1)th capacitor Cj+1), and a gate electrode connected to the third selection line SL3. The third switch element M3 may connect the (k+2)th scan line Sk+2 to the (j+1)th connection line ESj+1 (or (j+1)th capacitor Cj+1) in response to the third selection signal transmitted through the third selection line SL3.

The fourth switching element M4 may include a first electrode connected to the (k+3)th scan line Sk+3, a second electrode connected to the (j+1)th connection line ESj+1 (or (j+1)th capacitor Cj+1), and a gate electrode connected to the fourth selection line SL4. The fourth switching element M4 may connect the (k+3)th scan line Sk+3 to the (j+1)th connection line ESj+1 (or (j+1)th capacitor Cj+1) in response to the fourth selection signal transmitted through the fourth selection line SL4.

That is, the third and fourth switching elements M3 and M4 may operate independently from the first and second switching elements M1 and M2. Thus, the selector DEM can be more stably operated. This will be described with reference to FIG. 11.

Figure 11:
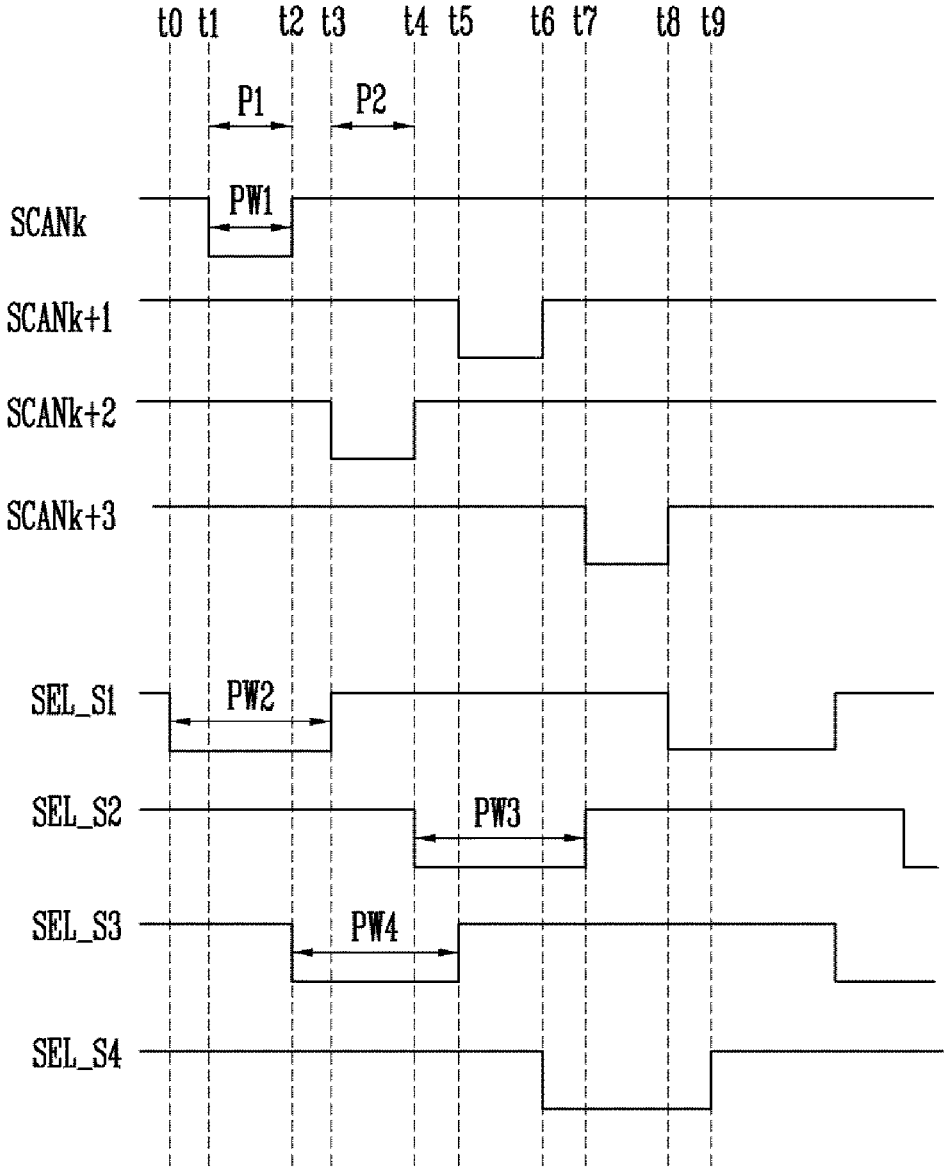
FIG. 11 is a waveform diagram illustrating an example of signals measured in the selector shown in FIG. 10.

FIG. 11 is a waveform diagram illustrating an example of signals measured in the selector shown in FIG. 10.

Referring to FIGS. 10 and 11, at a zeroth time t0 (or reference time), a first selection signal SEL_S1 transmitted through the first selection line SL1 may be changed to the turn-on voltage level. The first switching element M1 of the selector DEM may be turned on in response to the first selection signal SEL_S1 having the turn-on voltage level, and the kth scan line Sk and the jth connection line ESj (or jth capacitor Cj) may be connected to each other.

At a first time t1, a kth scan signal SCANk transmitted to the kth scan line Sk may be changed to the turn-on voltage level. A kth pixel PXLk may be selected in response to the kth scan signal SCANk having the turn-on voltage level, or a data signal may be recorded in the kth pixel PXLk.

At a second time t2, the kth scan signal SCANk may be changed to the turn-off voltage level.

Also, at the second time t2, a third selection signal SEL_S3 transmitted through the third selection line SL3 may be changed to the turn-on voltage level. The third switching element M3 may be turned on in response to the third selection signal SEL_S3 having the turn-on voltage level, and the (k+2)th scan line Sk+2 and the (j+1)th connection line ESj+1 (or (j+1)th capacitor Cj+1) may be connected to each other. A turn-on section of the first switching element M1 may overlap with that of the third switching element M3. The first switching element M1 and the third switching element M3 are connected to the jth capacitor Cj and the (j+1)th capacitor Cj+1, which are different from each other, and therefore, a load of each of the kth and (k+1)th scan lines Sk and Sk+1 may be normally compensated.

At a third time t3, the first selection signal SEL_S1 may be changed to the turn-off voltage level. That is, a pulse width PW2 of the first selection signal SEL_S1 may be wider than that PW1 of the kth scan signal SCANk, and the load of the kth scan line Sk may be adjusted by the jth capacitor Cj before/after the kth scan signal SCANk having the turn-on voltage level is applied to the kth scan line Sk.

Thus, a modification of the kth scan signal SCANk, etc. due to a turn-on/turn-off operation of the first switching element M1 can be prevented. In addition, a switching time (i.e., a time at which the first to fourth switching elements M1 to M4 are turned on) of the selector DEM can be sufficiently secured, and load compensation for scan lines Sk to Sk+3 can be stably performed even in a high-resolution display device in which the pulse width of a scan signal is narrower.

Also, at the third time t3, a (k+2)th scan signal SCANk+2 transmitted to the (k+2)th scan line Sk+2 may be changed to the turn-on voltage level. That is, a scan signal having the turn-on voltage level may be applied to the (k+2)th scan line Sk+2 connected to the (j+1)th capacitor Cj+1, instead of the (k+1)th scan line Sk+1 sharing the jth capacitor Cj with the kth scan line Sk. Accordingly, although the pulse width PW2 of the first selection signal SEL_S1 is increased, only a desired pixel can be selected.

At a fourth time t4, the (k+2)th scan signal SCANk+2 and a second selection signal SEL_S2 are substantially identical to the kth scan signal SCANk and the first selection signal SEL_S1 at the second time t2, and therefore, overlapping descriptions will not be repeated.

A (k+1)th scan signal SCANk+1 and the second selection signal SEL_S2 between fifth to eighth times t5 to t8 may be substantially identical to the kth scan signal SCANk and the first selection signal SEL_S1 between the first to fourth times t1 to t4, and a (k+3)th scan signal SCANk+3 and a fourth selection signal SEL_S4 between the fifth to eighth times t5 to t8 may be substantially identical to the (k+2)th scan signal SCANk+2 and the third selection signal SEL_S3 between the first to fourth times t1 to t4. Therefore, overlapping descriptions will not be repeated.

According to the first to fourth selection signals SEL_S1 to SEL_S4, sections in which the first to fourth switching elements M1 to M4 are turned on may overlap with each other. For example, a second section in which the second switching element M2 is turned on in response to the second selection signal SEL_S2 may not overlap with each of a first section in which the first switching element M1 is turned on in response to the first selection signal SEL_S1. However, the first switching element M1 and the second switching element M2 are connected to the jth capacitor Cj, and therefore, the first section in which the first switching element M1 is turned on response to the first selection signal SEL_S1 may not overlap with the second section in which the second switching element M2 is turned on in response to the second selection signal SEL_S2. The pulse widths of the first to fourth selection signals SEL_S1 to SEL_S4 may be increased, in a range in which three of the first to fourth selection signals SEL_S1 to SEL_S4 do not have the turn-on voltage level at the same time, i.e., a range in which no more than two of the first to fourth selection signals SEL_S1 to SEL_S4 have the turn-on voltage level at the same time.

As described with reference to FIG. 11, the scan signals SCANk to SCANk+3 having the turn-on voltage level are provided in a staggered order to the scan lines Sk to Sk+3, and correspondingly, the first to fourth selection signals SEL_S1 to SEL_S4 having the turn-on voltage level are also provided in a staggered order to the selector DEM. In addition, the first to fourth selection signals SEL_S1 to SEL_S4 have pulse widths PW2, PW3, and PW4 wider than that PW1 of each of the scan signals SCANk to SCANk+3, and load compensation for the scan lines Sk to Sk+3 can be more stably compensated.

Figure 12:
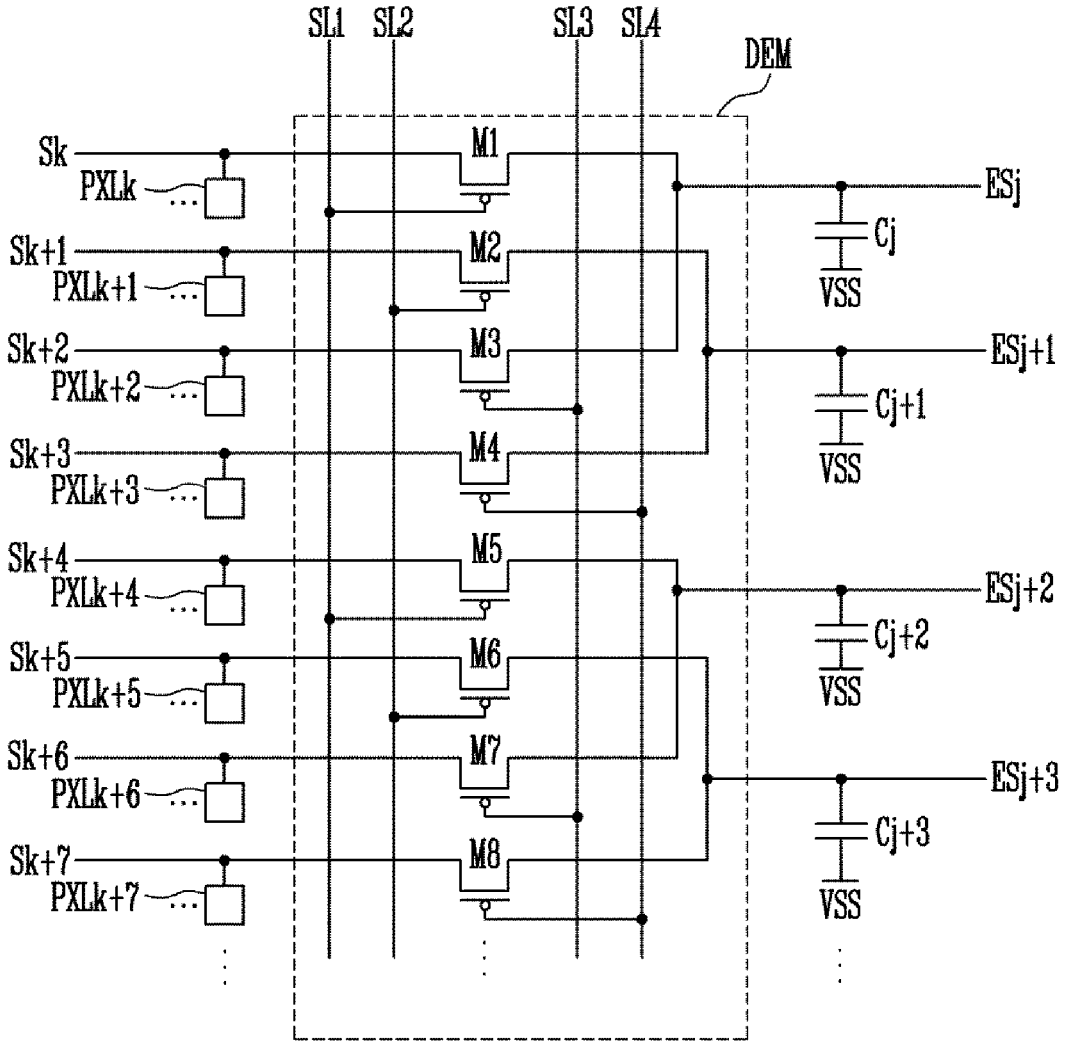
FIG. 12 is a circuit diagram illustrating still another example of the selector included in the display device shown in FIG. 5.

FIG. 12 is a circuit diagram illustrating still another example of the selector included in the display device shown in FIG. 5.

Referring to FIGS. 5, 10, and 12, a selector DEM may include first to eighth switching elements M1 to M8, and connect kth to (k+7)th scan lines Sk to Sk+7 and jth to (j+3)th connection lines ESj to ESj+3 (or jth to (j+3)th capacitors Cj to Cj+3) through the first to eighth switching elements M1 to M8.

A connection configuration between the (k+4)th to (k+7) th scan lines Sk+4 to Sk+7 and the (j+2)th and (j+3)th connection lines ESj+2 and ESj+3 through the fifth to eighth switching elements M5 to M8 is substantially identical to that between the kth to (k+3)th scan lines Sk to Sk+3 and the jth and (j+1)th connection lines ESj and ESj+1 through the first to fourth switching elements M1 to M4, and therefore, overlapping descriptions will not be repeated.

In addition, the selector DEM shown in FIG. 12 is substantially identical or similar to the selector DEM shown in FIG. 10, except a connection configuration of the second and third switching elements M2 and M3, and therefore, overlapping descriptions will not be repeated.

The second switching element M2 may include a first electrode connected to the (k+1)th scan line Sk+1, a second electrode connected to the (j+1)th connection line ESj+1 (or (j+1)th capacitor Cj+1), and a gate electrode connected to a second selection line SL2. The second switching element M2 may connect the (k+1)th scan line Sk+1 to the (j+1)th connection line ESj+1 (or (j+1)th capacitor Cj+1) in response to a second selection signal transmitted through the second selection line SL2.

The third switching element M3 may include a first electrode connected to the (k+2)th scan line Sk+2, a second electrode connected to the jth connection line ESj (or jth capacitor Cj), and a gate electrode connected to a third selection line SL3. The third switching element M3 may connect the (k+2)th scan line Sk+2 to the jth connection line ESj (or jth capacitor Cj) in response to a third selection signal transmitted through the third selection line SL3.

Adjacent gate lines may be connected to different connection lines (or different capacitors). The display device can more stably adjust a load of each of the gate lines while being driven in a sequential driving manner.

Figure 13A:
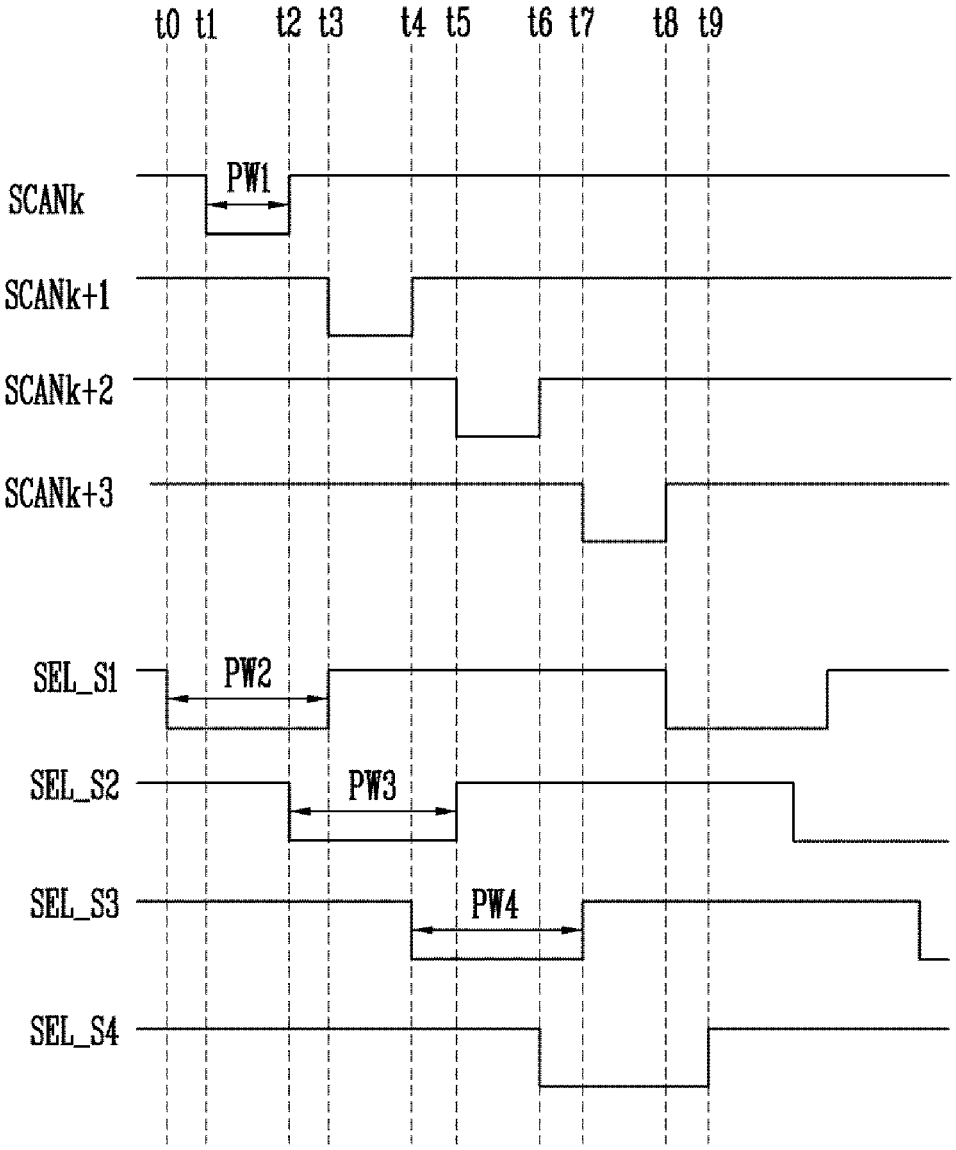
FIGS. 13A and 13B are waveform diagrams illustrating examples of signals measured in the selector shown in FIG. 12.
Figure 13B:
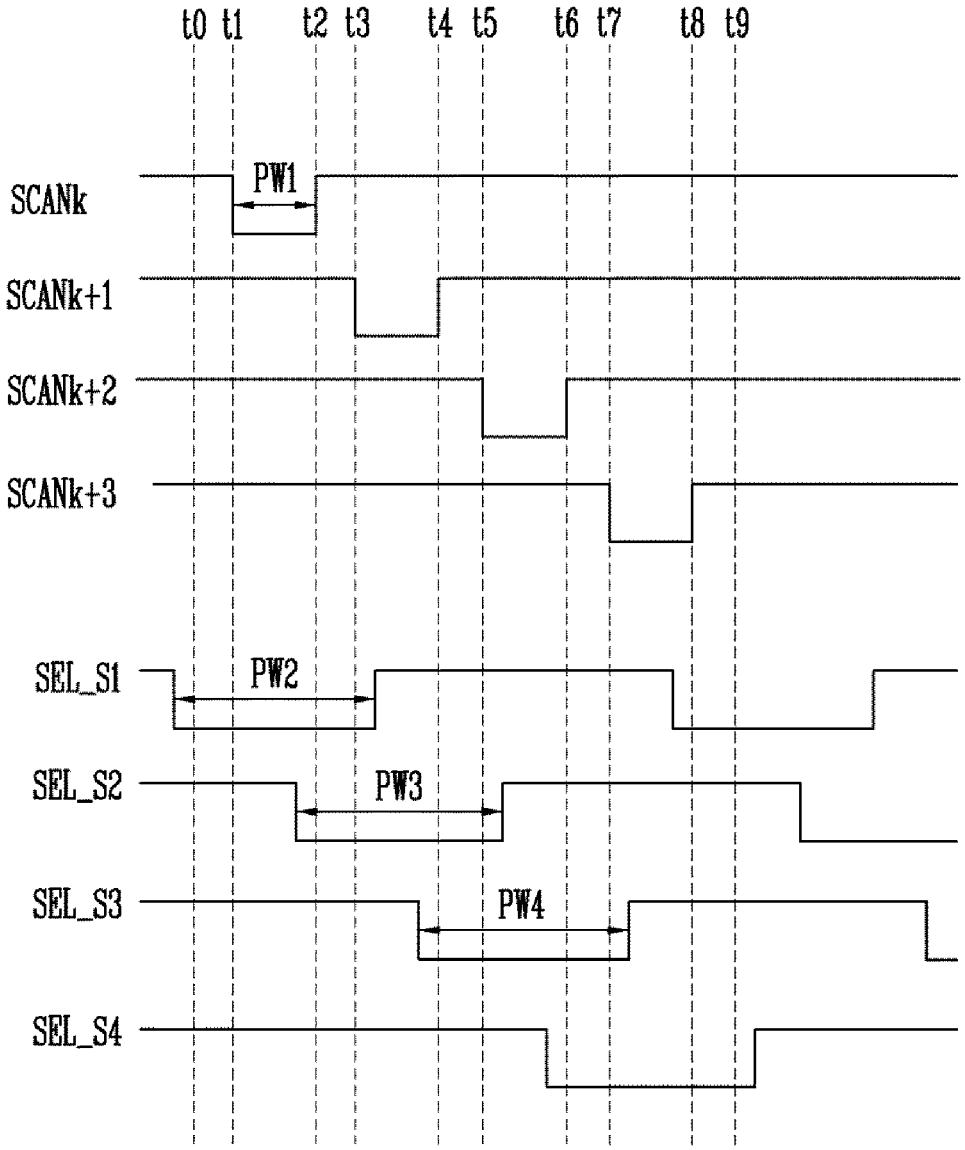

FIGS. 13A and 13B are waveform diagrams illustrating examples of signals measured in the selector shown in FIG. 12.

First, referring to FIGS. 11 and 13A, kth to (k+3)th scan signals SCANk to SCANk+3 respectively provided to the k to k+3 scan lines Sk to Sk+3 may sequentially have the turn-on voltage level, and correspondingly, the first to fourth selection signals SEL_S1 to SEL_S4 may sequentially have the turn-on voltage level.

The kth and (k+3)th scan signals SCANk and SCANk+3 may be substantially identical to the kth and (k+3)th scan signals SCANk and SCANk+3 described with reference to FIG. 11, the (k+1)th scan signal SCANk+1 may be substantially identical to the (k+2)th scan signal SCANk+2 described with reference to FIG. 11, and the (k+2)th scan signal SCANk+2 may be substantially identical to the (k+1) th scan signal SCANk+1 described with reference to FIG. 11. In addition, the first and fourth selection signals SEL_S1 and SEL_S4 may be substantially identical to the first and fourth selection signals SEL_S1 and SEL_S4 described with reference to FIG. 11, the second selection signal SEL_S2 may be substantially identical to the third selection signal SEL_S3 described with reference to FIG. 11, and the third selection signal SEL_S3 may be substantially identical to the second selection signal SEL_S2 described with reference to FIG. 11. Therefore, overlapping descriptions will not be repeated.

That is, the display device including the selector DEM described with reference to FIGS. 10 and 11 operates by using the first to fourth selection signals SEL_S1 to SEL_S4 having wider pulse widths according to the kth to (k+3)th scan signals SCANk to SCANk+3 having a staggered order. However, the display device including the selector DEM described with reference to FIGS. 12 and 13A connects adjacent gate lines to different capacitors, to operate in a sequential driving manner.

Referring to FIGS. 13A and 13B, first to fourth selection signals SEL_S1 to SEL_S4 shown in FIG. 13B may have pulse widths wider than the first to fourth selection signals SEL_S1 to SEL_S4 shown in FIG. 13A, respectively.

For example, the second selection signal SEL_S2 may be changed to the turn-on voltage level before a second time t2, and be changed to the turn-off voltage level after a fifth time t5. Therefore, a second section in which the second selection signal SEL_S2 has the turn-on voltage level (or the second section in which the second switching element M2 is turned on) may overlap with a section in which the (k+1)th scan signal SCANk+1 has the turn-on voltage level, and partially overlap with a section in which the kth scan signal SCANk has the turn-on voltage level and a section in which the (k+2)th scan signal SCANk+2 has the turn-on voltage level.

That is, the pulse widths of the first to fourth selection signals SEL_S1 to SEL_S4 may be further increased, in a range in which no more than two of the first to fourth selection signals SEL_S1 to SEL_S4 have the turn-on voltage level at the same time.

Figure 14:
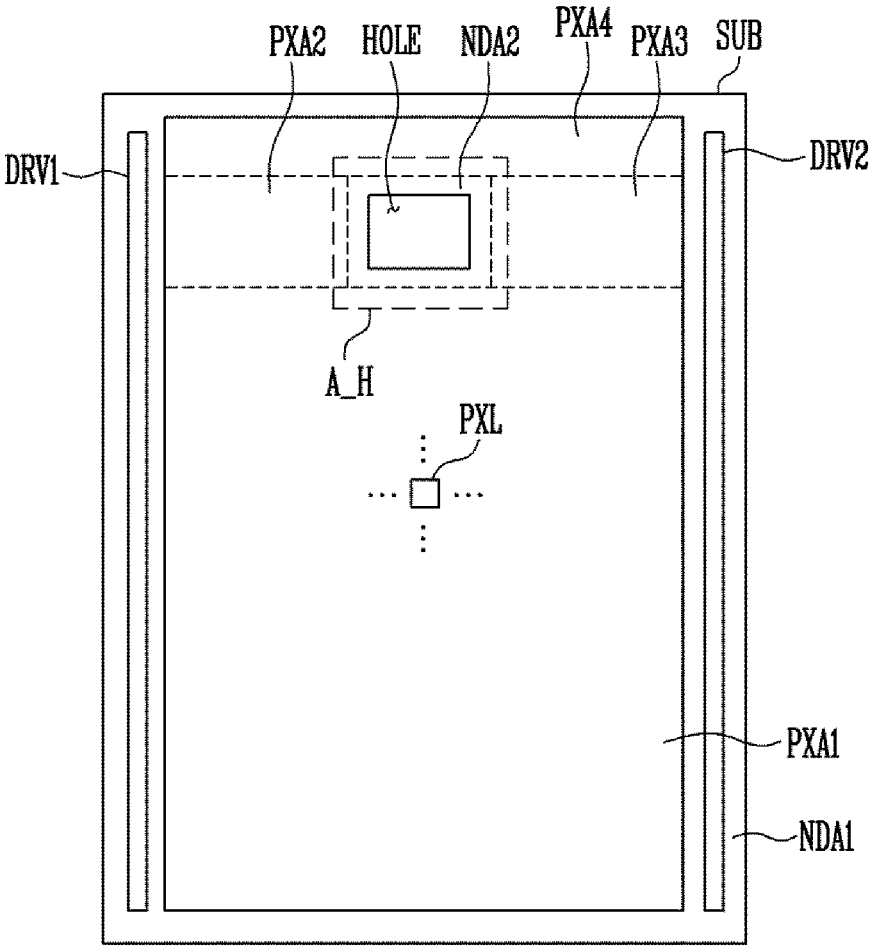
FIG. 14 is a plan view illustrating a display device in according to some example embodiments of the present disclosure.

FIG. 14 is a plan view illustrating a display device in according to some example embodiments of the present disclosure.

Referring to FIGS. 1 and 14, the display device shown in FIG. 14 is different from the display device shown in FIG. 1 in that the display device shown in FIG. 14 includes a hole HOLE instead of the notch.

The display device may include a substrate SUB, pixels PXL provided on the substrate SUB, drivers DRV1 and DRV2 provided on the substrate SUB to drive the pixels PXL, and a line part connecting the pixels PXL and the drivers DRV1 and DRV2.

Except the hole HOLE, the substrate SUB may be substantially identical or similar to the substrate SUB described with reference to FIG. 1. The drivers DRV1 and DRV2, the pixels PXL, and the line part are substantially identical to the driver, the pixels PXL1, PXL2, and PXL3, and the line part, which are described with reference to FIGS. 1 to 3D, respectively. Therefore, overlapping descriptions will not be repeated.

The hole HOLE penetrating the substrate SUB may be formed in an opening region A_H of the substrate SUB. Although a case where the hole HOLE has a quadrangular planar shape is illustrated in FIG. 14, this is merely illustrative, and the hole HOLE may have a planar shape such as a circular shape, an elliptical shape, or a polygonal shape having a rounded corner.

The substrate SUB may include a pixel region PXA (or display region) and a first non-pixel region NDA1 (or first non-display region) that is located along an edge of the pixel region PXA and surrounds the pixel region PXA. The hole HOLE may be located in the pixel region PXA, and the substrate SUB may further include a second non-pixel region NDA2 (or second non-display region) located along an edge of the hole HOLE. The first and second non-pixel regions NDA1 and NDA2 may be portions of the substrate SUB, at which any image is not displayed, and the pixel region PXA may surround the second non-pixel region NDA2. The position of the hole HOLE may be variously changed.

The pixel region PXA may include first to fourth pixel regions PXA1, PXA2, PXA3, and PXA4 divided based on the hole HOLE (and drivers DRV1 and DRV2).

The first pixel region PXA1 and the fourth pixel region PXA4 may be portions of the substrate SUB, at which the hole HOLE is not formed, between first and second drivers DRV1 and DRV2. For example, the first pixel region PXA1 may be located at a lower side of the hole HOLE, and the fourth pixel region PXA4 may be located at an upper side of the hole HOLE. The first pixel region PXA1 and the fourth pixel region PXA4 may be substantially identical or similar to the first pixel region PXA1 described with reference to FIG. 1.

The second pixel region PXA2 and the third pixel region PXA3 may be portions divided by the hole HOLE between the first and second drivers DRV1 and DRV2. For example, the second pixel region PXA2 may be located at a left side of the hole HOLE (i.e., in a direction in which the first driver DRV1 is located based on the hole HOLE), and the third pixel region PXA3 may be located at a right side of the hole HOLE. The second pixel region PXA2 and the third pixel region PXA3 may be substantially identical or similar to the second pixel region PXA2 and the third pixel region PXA3, which are described with reference to FIG. 1, respectively.

Figure 15:
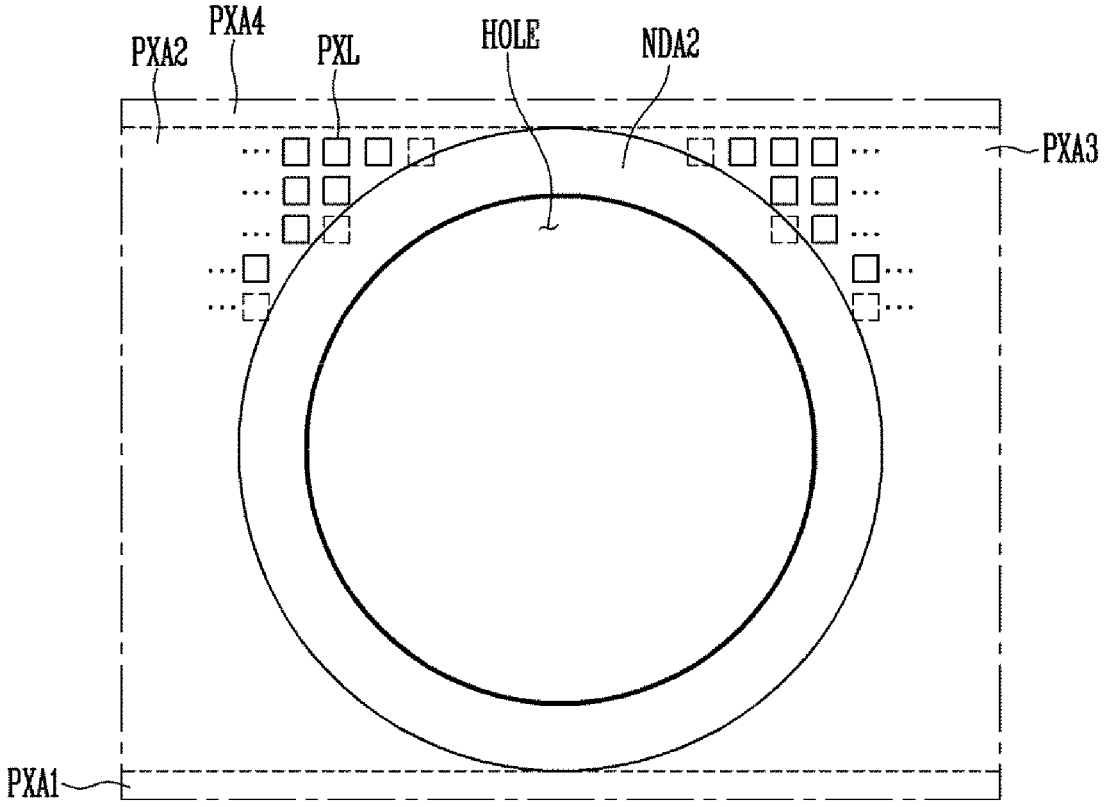
FIG. 15 is a plan view illustrating an example of an opening region included in the display device shown in FIG. 14.

FIG. 15 is a plan view illustrating an example of the opening region included in the display device shown in FIG. 14. In FIG. 15, an opening region A_H is illustrated based on pixels PXL.

Referring to FIG. 15, the opening region A_H may include portions of first to fourth pixel regions PXA1 to PXA4 and a second non-pixel region NDA2 with a hole HOLE as the center. For convenience of description with respect to a number of pixels for each row, a case where the hole HOLE has a circular shape is illustrated in FIG. 15. In the opening region A_H, the third pixel region PXA3 is symmetric to the second pixel region PXA2 with respect to the hole HOLE, and therefore, the second pixel region PXA2 will be mainly described.

In the second pixel region PXA2, the number of second pixels PXL2 may vary depending on rows. A number of pixels PXL located in a row adjacent to the first pixel region PXA1 may be greater than that of pixels PXL located in a row spaced apart from the first pixel region PXA1. According to the number of pixels PXL, the length of a line connecting the corresponding pixels PXL may vary.

According to some example embodiments, some of rows in the second pixel region PXA2 may include the same number of pixels PXL. For example, a number of pixels included in a second row may be equal to that of pixels included in a third row. A length and a load of a first line (e.g., a first scan line) connected to the pixels of the second row may be substantially equal or similar to those of a second line (e.g., a second scan line) connected to the pixels of the third row. Therefore, the first line may share a load matching capacitor with the second line. The load matching capacitor may be identical or similar to at least one of the first to third load matching capacitors LMC1 to LMC3 described with reference to FIGS. 3A to 3D. That is, lines (e.g., scan lines) corresponding to adjacent rows have length and loads, which are equal or similar to each other. Therefore, the lines may share a load matching capacitor with each other.

Figure 16:
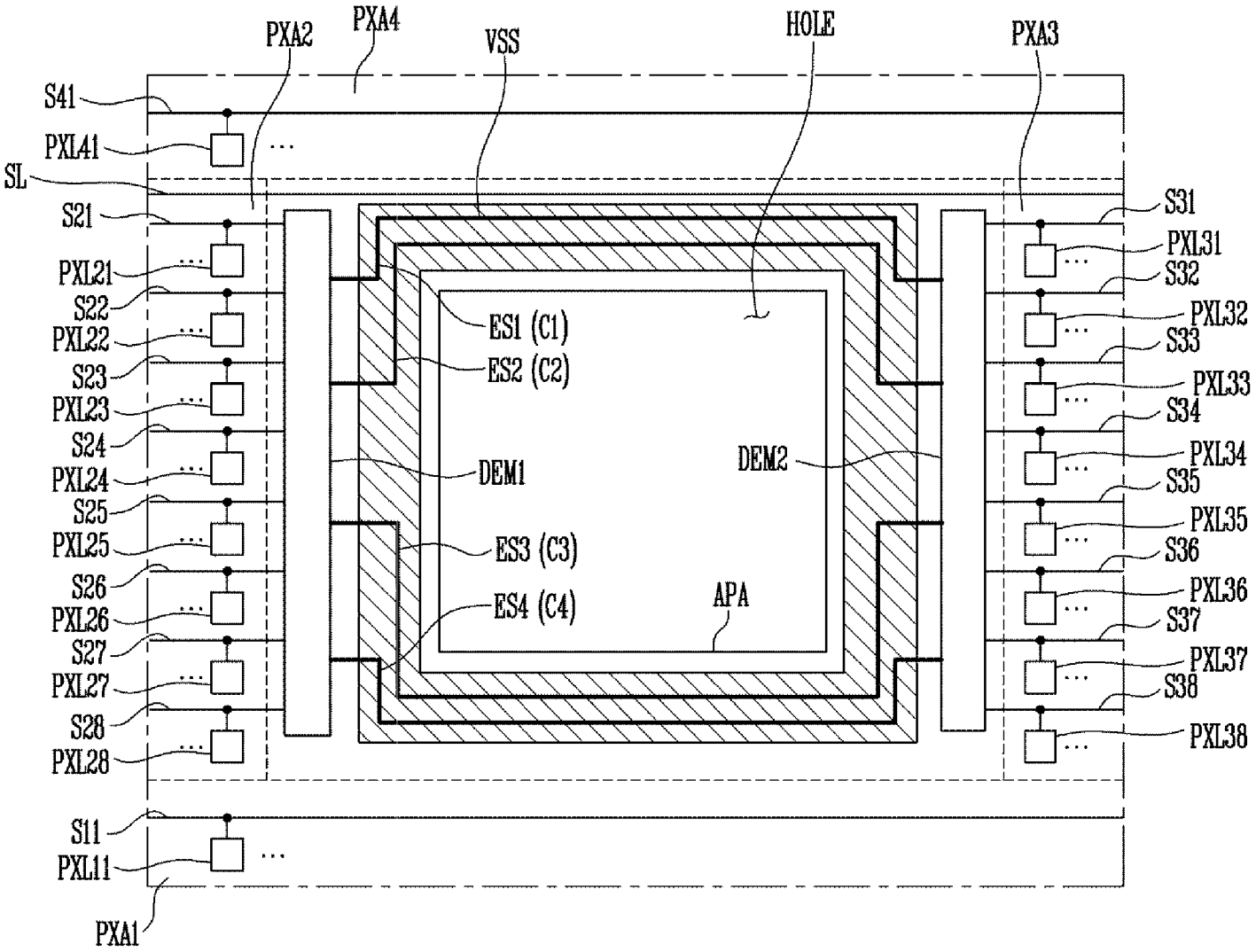
FIG. 16 is a plan view illustrating another example of the opening region included in the display device shown in FIG. 14.

FIG. 16 is a plan view illustrating another example of the opening region included in the display device shown in FIG. 14.

Referring to FIGS. 14 and 16, the display device may include the substrate SUB, pixels PXL11, PXL21 to PXL28, PXL31 to PXL38, and PXL41, scan lines S11, S21 to S28, S31 to S38, and S41, first and second selectors DEM1 and DEM2 (or first and second selection circuits), connection lines ES1 to ES4 (or capacitors C1 to C4), and a second power supply line VSS.

The pixels PXL11, PXL21 to PXL28, and PXL31 to PXL38 except a first pixel PXL41 of the fourth pixel region PXA4, the scan lines S11, S21 to S28, and S31 to S38 except a first scan line S41 of the fourth pixel region PXA4, the first and second selectors DEM1 and DEM2, and first to fourth connection lines ES1 to ES4 may be substantially identical to the pixels PXL11, PXL21 to PXL28, and PXL31 to PXL38, the scan lines S11, S21 to S28, and S31 to S38, the second and fourth sub-selectors DEM12 and DEM22, and the first to fourth connection lines ES1 to ES4, which are described with reference to FIG. 5, respectively. Therefore, overlapping descriptions will not be repeated.

The first pixel PXL41 of the fourth pixel region PXA4 and the first scan line S41 of the fourth pixel region PXA4 may be substantially identical to a first pixel PXL11 of the first pixel region PXA1 and a first scan line S11 of the first pixel region PXA1, respectively. In addition, the first and second connection lines ES1 and ES2 may be substantially identical or similar to the third and fourth connection lines ES3 and ES4. Therefore, overlapping descriptions will not be repeated.

The second power supply line VSS may be similar to the second power supply line VSS described with reference to FIG. 5. The second power supply line VSS may be located in the second non-pixel region NDA2. The second power supply line VSS may constitute a closed loop and surround the hole HOLE. The first to fourth connection lines ES1 to ES4 may form first to fourth capacitors C1 to C4 by partially overlapping with the second power supply line VSS.

In some embodiments, the display device may further include a selection line SL. The selection line SL may extend in a row direction, and be connected to the first and second selectors DEM1 and DEM2. Although a case where the selection line SL is provided as one line is illustrated in FIG. 16, this is merely illustrative, and the selection line SL may include a plurality of lines according to a circuit configuration of the first and second selectors DEM1 and DEM2.

The extending direction of the selection line SL is illustrated as an example, and the present disclosure is not limited thereto. For example, similarly to the first and second selection lines SL1 and SL2 shown in FIG. 7, the selection line SL may extend in a column direction.

Each of the first and second selectors DEM1 and DEM2 may have the circuit configuration described with reference to FIGS. 7 to 13B.

Although a case where the first to fourth connection lines ES1 to ES4 are shared by all gate lines in the second and third pixel regions PXA2 and PXA3 is illustrated in FIG. 16, this is illustrated as an example, and the present disclosure is not limited thereto. For example, the display device may include the first and second connection lines ES1 and ES2 shown in FIG. 5, and include a connection line that is not shared and is fixedly connected to a specific gate line (e.g., a gate line having a unique load different from those of other gate lines).

As described with reference to FIGS. 14 to 16, a configuration in which gate lines share a capacitor for load adjustment can be applied to the display device including the hole HOLE. Also, the configuration in which the gate lines share the capacitor for load adjustment can be applied to a display device including gate lines having different lengths and/or loads.

While aspects of the present invention has been described in connection with some example embodiments, it will be understood by those skilled in the art that various modifications and changes can be made thereto without departing from the spirit and scope of the invention defined by the claims, and their equivalents.

Thus, the scope of the invention should not be limited by the particular embodiments described herein but should be defined by the claims and equivalents thereof.

What is claimed is:

1. A display device comprising:

a substrate including a first region and a second region at one side of the first region;

a plurality of pixels in the first region;

a first gate line connected to a first pixel among the pixels;

a second gate line connected to a second pixel among the pixels;

a first capacitor in the second region; and a first selector configured to select one of the first gate line and the second gate line and connect the selected one to the first capacitor, the display device further comprising a first selection line and a second selection line, wherein the first selector includes:

a first switching element including a first electrode connected to the first pate line, a second electrode connected to the first capacitor, and a gate electrode connected to the first selection line; and a second switching element including a first electrode connected to the second gate line, a second electrode connected to the first capacitor, and a pate electrode connected to the second selection line.

2. The display device of claim 1, wherein the first capacitor includes:

a power supply line in the second region, the power supply line being connected to the pixels; and a connection line overlapping with the power supply line, wherein the first selector is configured to connect one selected from the first gate line and the second gate line to the connection line.

3. The display device of claim 2, wherein the first switching element is configured to be turned on while a gate signal having a turn-on voltage level is being applied to the first gate line, and the second switching element is configured to be turned on while a gate signal having a turn-on voltage level is being applied to the second gate line.

4. The display device of claim 3, wherein a first section in which the first switching element is turned on does not overlap with a second section in which the second switching element is turned on.

5. The display device of claim 2, further comprising:

a third gate line connected to a third pixel among the pixels; and a third selection line, wherein the first selector further includes a third switching element including a first electrode connected to the third gate line, a second electrode connected to the first capacitor, and a gate electrode connected to the third selection line.

6. The display device of claim 2, further comprising:

a third gate line connected to a third pixel among the pixels;

a fourth gate line connected to a fourth pixel among the pixels;

a second capacitor in the second region;

a third selection line; and a fourth selection line, wherein the first selector further includes:

a third switching element including a first electrode connected to the third gate line, a second electrode connected to the second capacitor, and a gate electrode connected to the third selection line; and a fourth switching element including a first electrode connected to the fourth gate line, a second electrode connected to the second capacitor, and a gate electrode connected to the fourth selection fine.

7. The display device of claim 6, wherein a first section in which the first switching element is turned on is larger than a section in which a gate signal applied to the first gate line has a turn-on voltage level.

8. The display device of claim 6, wherein a first section in which the first switching element is turned on does not overlap with a second section in which the second switching element is turned on, and a third section in which the third switching element is turned on partially overlaps with each of the first section and the second section.

9. The display device of claim 2, further comprising:

a third gate line between the first gate line and the second gate fine, the third gate line being connected to a third pixel among the pixels;

a second capacitor in the second region; and a third selection line, wherein the first selector further includes a third switching element including a first electrode connected to the third gate line, a second electrode connected to the second capacitor, and a gate electrode connected to the third selection line.

10. The display device of claim 9, wherein a first section in which the first switching element is turned on does not overlap with a second section in which the second switching element is turned on, and a third section in which the third switching element is turned on partially overlaps with each of the first section and the second section.

11. The display device of claim 1, further comprising a third gate line, wherein the substrate further includes a third region adjacent to each of the first region and the second region, wherein the third gate line is connected to a third pixel in the third region, wherein the first gate line is shorter than the third gate line.

12. The display device of claim 11, wherein the second region is surrounded by the first region and the third region.

13. The display device of claim 1, further comprising a first driver at one side of the substrate, the first driver being connected to the first gate line and the second gate line, the first driver providing a gate signal having a turn-on voltage level to the first gate line and the second gate line in different sections.

14. The display device of claim 13, further comprising a second driver at the other side of the substrate, the second driver being connected to the first gate He and the second gate line, the second driver providing the gate signal to the first gate line and the second gate line.

15. The display device of claim 13, wherein the second gate line has a bad equal to that of the first gate line.

16. The display device of claim 13, further comprising a load controller configured to provide a first selection signal for selecting the first gate line to the first selector in a section in which the gate signal is applied to the first gate line.

17. A display device comprising:

a substrate including a first region and a second region at one side of the first region;

a plurality of pixels in the first region;

a first gate line connected to a first pixel among the pixels;

a second gate line connected to a second pixel among the pixels;

a first capacitor in the second region;

a first selector configured to alternatively select one of the first gate line and the second gate line and connect the selected one to the first capacitor;

a third gate line;

a fourth gate line; and a second selector configured to alternately connect the third gate line and the fourth gate line to the first capacitor, wherein the substrate further includes a third region spaced apart from the first region with respect to the second region, wherein the third gate line is connected to a third pixel in the third region, and is connected to the first gate line through the second selector, the first capacitor, and the first selector, and wherein the fourth gate line is connected to a forth pixel in the third region, and is connected to the second gate line through the second selector, the first capacitor, and the first selector.

18. A display device comprising:

a substrate including a first region and second and third regions spaced apart from each other with respect to the first region;

a plurality of first pixels provided in the second region;

a plurality of second pixels provided in the third region;

a plurality of first gate lines connected to the first pixels;

a plurality of second gate lines connected to the second pixels;

a connection line in the first region;

a first selector configured to select one of the first gate lines and connect the selected one to the connection line; and a second selector configured to select one of the second gate lines and connect the selected one to the connection line, the display device further comprising a first selection line and a second selection line, wherein the first selector includes:

a first switching element including a first electrode connected to a first gate line of the first pate fines, a second electrode connected to a first capacitor, and a gate electrode connected to the first selection fine; and a second switching element including a first electrode connected to a second gate line of the second pate lines, a second electrode connected to the first capacitor and a gate electrode connected to the second selection line.

19. The display device of claim 18, further comprising a power supply line in the second region, the power supply line being connected to the first and second pixels, wherein the connection line forms a capacitor by partially overlapping with the power supply line.

* * * * *